US012492045B2

(12) United States Patent
Lohrman et al.

(10) Patent No.: US 12,492,045 B2
(45) Date of Patent: Dec. 9, 2025

(54) TETHERED, HINGED CLOSURE

(71) Applicant: Silgan White Cap LLC, Downers Grove, IL (US)

(72) Inventors: Richard D. Lohrman, Montgomery, IL (US); Sungsuk Steve Kim, Batavia, IL (US); Gary L. Berge, Crystal Lake, IL (US); Dustin Vance, Lombard, IL (US); Darren R. Neputy, Palos Hills, IL (US); Nicholas Arthur Davies, Downers Grove, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 136 days.

(21) Appl. No.: 17/674,618

(22) Filed: Feb. 17, 2022

(65) Prior Publication Data

US 2022/0169423 A1 Jun. 2, 2022

Related U.S. Application Data

(63) Continuation of application No. PCT/US2020/049493, filed on Sep. 4, 2020.

(60) Provisional application No. 63/023,543, filed on May 12, 2020, provisional application No. 63/004,184, filed on Apr. 2, 2020, provisional application No.
(Continued)

(51) Int. Cl.
*B65D 41/34* (2006.01)
*B65D 55/16* (2006.01)

(52) U.S. Cl.
CPC ..... *B65D 41/3428* (2013.01); *B65D 41/3447* (2013.01); *B65D 55/16* (2013.01); *B65D 2401/30* (2020.05)

(58) Field of Classification Search
CPC ..... B65D 2401/30; B65D 41/3428; B65D 41/3447; B65D 55/16
See application file for complete search history.

(56) References Cited

U.S. PATENT DOCUMENTS 2,990,077 A 6/1961 Van Baarn
3,335,889 A 8/1967 Brumme
(Continued)

FOREIGN PATENT DOCUMENTS

CA 2990674 9/2018
CN 1631740 6/2005
(Continued)

OTHER PUBLICATIONS

International Search Report and Written Opinion for International Application No. PCT/US2020/049493, dated Dec. 17, 2020, 13 pages.
(Continued)

*Primary Examiner* — Don M Anderson
*Assistant Examiner* — Jennifer Castriotta
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. A tab is formed at a hinge location from the band and extending from the lower edge of the skirt to one or more lines of weakness.

13 Claims, 24 Drawing Sheets

FIG. 3

Related U.S. Application Data

62/900,917, filed on Sep. 16, 2019, provisional application No. 62/897,005, filed on Sep. 6, 2019.

(56) References Cited

U.S. PATENT DOCUMENTS

| | | | | |
|---|---|---|---|---|
| 3,441,161 | A | 4/1969 | Van Baarn | |
| 4,394,918 | A | 7/1983 | Grussen | |
| 4,557,393 | A | 12/1985 | Boik | |
| 4,565,295 | A | 1/1986 | Mori et al. | |
| 4,666,053 | A | 5/1987 | Corcoran et al. | |
| 4,805,792 | A | 2/1989 | Lecinski, Jr. | |
| 5,215,204 | A | 6/1993 | Beck et al. | |
| 5,295,600 | A | 3/1994 | Kowal | |
| 5,360,126 | A | 11/1994 | Snyder et al. | |
| 5,398,837 | A | 3/1995 | Degrassi | |
| 5,676,269 | A | 10/1997 | Blake et al. | |
| 5,725,115 | A | 3/1998 | Bosl et al. | |
| 5,735,418 | A | 4/1998 | Erb et al. | |
| 5,779,075 | A | 7/1998 | Salmon et al. | |
| 5,853,095 | A | 12/1998 | Marshall et al. | |
| 6,102,257 | A | 8/2000 | Goyet | |
| 6,116,443 | A | 9/2000 | Parrinello | |
| 6,372,167 | B1 | 4/2002 | Morini | |
| 6,474,491 | B1 | 11/2002 | Benoit-Gonin et al. | |
| 6,478,184 | B2 | 11/2002 | Berge et al. | |
| 6,986,434 | B1 | 1/2006 | Getsy et al. | |
| 7,314,150 | B2 | 1/2008 | Skillen | |
| D593,856 | S | 6/2009 | Kubler | |
| 7,712,618 | B2 | 5/2010 | Barre et al. | |
| D648,215 | S | 11/2011 | Rigling et al. | |
| 8,469,213 | B2 * | 6/2013 | Ishii | B65D 41/3428 220/837 |
| 8,490,805 | B2 | 7/2013 | Giraud et al. | |
| 8,602,234 | B2 | 12/2013 | Hayashi | |
| 8,695,822 | B2 | 4/2014 | Kwon | |
| 8,720,716 | B2 | 5/2014 | Campbell | |
| 9,010,555 | B2 | 4/2015 | Luzzato et al. | |
| 9,108,774 | B2 | 8/2015 | Kwon | |
| 9,376,243 | B2 | 6/2016 | Cerveny | |
| 9,643,762 | B2 | 5/2017 | Maguire | |
| 9,776,779 | B2 | 10/2017 | Campbell | |
| 9,828,146 | B2 | 11/2017 | Maguire | |
| 9,932,159 | B2 | 4/2018 | Maguire | |
| 9,975,677 | B2 | 5/2018 | Maguire | |
| 10,138,035 | B2 | 11/2018 | Loukov | |
| 10,272,599 | B2 | 4/2019 | Cerveny | |
| 10,518,942 | B2 | 12/2019 | Seibert et al. | |
| 10,647,486 | B2 | 5/2020 | Maguire | |
| 10,654,624 | B2 | 5/2020 | Sung | |
| 10,654,625 | B2 | 5/2020 | Migas et al. | |
| 10,836,549 | B2 | 11/2020 | Maguire | |
| 10,981,700 | B2 | 4/2021 | Migas et al. | |
| 11,040,806 | B2 | 6/2021 | Naumann et al. | |
| 2003/0136783 | A1 | 7/2003 | Hatsumoto et al. | |
| 2006/0049204 | A1 | 3/2006 | Seelhofer | |
| 2006/0071000 | A1 | 4/2006 | Weist et al. | |
| 2006/0163281 | A1 | 7/2006 | Weist | |
| 2007/0151993 | A1 | 7/2007 | Yelland | |
| 2008/0105640 | A1 | 5/2008 | Ott | |
| 2008/0185384 | A1 | 8/2008 | Bolli | |
| 2009/0236304 | A1 | 9/2009 | Watson | |
| 2009/0302037 | A1 | 12/2009 | Rigling | |
| 2010/0237073 | A1 | 9/2010 | Alther et al. | |
| 2010/0326948 | A1 | 12/2010 | Campbell | |
| 2011/0000871 | A1 | 1/2011 | Bernard et al. | |
| 2011/0174760 | A1 | 7/2011 | Luzzato et al. | |
| 2012/0024815 | A1 | 2/2012 | Kwon | |
| 2012/0298666 | A1 | 11/2012 | Kwon | |
| 2013/0001184 | A1 | 1/2013 | Groubert | |
| 2013/0001185 | A1 | 1/2013 | Antier et al. | |
| 2015/0144630 | A1 | 5/2015 | Backes et al. | |
| 2015/0259109 | A1 | 9/2015 | Vetten et al. | |
| 2018/0118423 | A1 | 5/2018 | Bois et al. | |
| 2018/0186505 | A1 | 7/2018 | Peterges et al. | |
| 2018/0370701 | A1 | 12/2018 | Maguire | |
| 2019/0071222 | A1 | 3/2019 | Druitt | |
| 2019/0106246 | A1 | 4/2019 | Kendall | |
| 2019/0344933 | A1 | 11/2019 | Kim | |
| 2019/0344944 | A1 * | 11/2019 | Maguire | B65D 41/34 |
| 2019/0375555 | A1 | 12/2019 | Edie et al. | |
| 2020/0017260 | A1 | 1/2020 | Migas et al. | |
| 2020/0115115 | A1 | 4/2020 | Migas et al. | |
| 2020/0207525 | A1 | 7/2020 | Sung | |
| 2020/0369446 | A1 * | 11/2020 | Mélan-Moutet | B65D 41/3447 |
| 2020/0377259 | A1 | 12/2020 | Reisert et al. | |
| 2020/0399036 | A1 * | 12/2020 | Dai | B65D 41/325 |
| 2020/0407124 | A1 | 12/2020 | Caszatt et al. | |
| 2021/0039838 | A1 | 2/2021 | Hanan | |
| 2021/0094733 | A1 | 4/2021 | Bloom et al. | |
| 2021/0094736 | A1 | 4/2021 | Maguire | |
| 2021/0179324 | A1 | 6/2021 | Hanan | |
| 2021/0188488 | A1 | 6/2021 | Dreyer et al. | |
| 2021/0221572 | A1 * | 7/2021 | Migas | B65D 41/3428 |
| 2022/0002021 | A1 | 1/2022 | Krautkramer | |

FOREIGN PATENT DOCUMENTS

| | | |
|---|---|---|
| CN | 1631741 | 6/2005 |
| CN | 1830730 | 9/2006 |
| CN | 201209040 | 3/2009 |
| CN | 102700822 | 10/2012 |
| CN | 102700823 | 10/2012 |
| DE | 9318243 | 2/1994 |
| DE | 4123732 | 8/1998 |
| DE | 102009010681 | 1/2010 |
| DE | 202019106993 | 1/2020 |
| DE | 202019106992 | 2/2020 |
| DE | 102018128886 | 7/2020 |
| DE | 102018130541 | 7/2020 |
| DE | 102019132541 | 11/2020 |
| DE | 102020107184 | 5/2021 |
| DE | 102019132538 | 6/2021 |
| DE | 202021103289 | 8/2021 |
| EP | 1529736 | 5/2005 |
| EP | 1961669 | 8/2008 |
| EP | 3081505 | 10/2016 |
| EP | 3135600 | 3/2017 |
| EP | 3336003 | 6/2018 |
| EP | 3584190 | 12/2019 |
| EP | 3715275 | 9/2020 |
| EP | 3715276 | 9/2020 |
| EP | 3766797 | 1/2021 |
| EP | 3798150 | 3/2021 |
| EP | 3831736 | 6/2021 |
| ES | 1266291 | 4/2021 |
| FR | 2711969 | 5/1995 |
| FR | 2953202 | 6/2011 |
| FR | 3084881 | 2/2020 |
| FR | 3093709 | 9/2020 |
| JP | 11-500091 | 1/1999 |
| JP | 2001019002 | 1/2001 |
| JP | 2004307006 | 11/2004 |
| JP | 2005041566 | 2/2005 |
| JP | 2005289488 | 10/2005 |
| JP | 4906441 | 3/2008 |
| JP | 2011-201559 | 10/2011 |
| JP | 2014-061929 | 4/2014 |
| JP | 5520768 | 6/2014 |
| JP | 5574582 | 8/2014 |
| JP | 5600461 | 10/2014 |
| KR | 20-0213792 | 2/2001 |
| KR | 10-0855086 | 8/2008 |
| KR | 20080093839 | 10/2008 |
| KR | 10-0872159 | 1/2009 |
| KR | 10-0942642 | 2/2010 |
| KR | 10-0981240 | 9/2010 |
| KR | 1017448460000 | 6/2017 |
| MX | 2007015318 | 2/2008 |
| WO | WO94/14674 | 7/1994 |
| WO | WO00/26108 | 5/2000 |
| WO | WO2002/062674 | 8/2002 |
| WO | WO2005/073098 | 8/2005 |
| WO | WO2008/142413 | 11/2008 |
| WO | WO2009/048273 | 4/2009 |

(56) References Cited

FOREIGN PATENT DOCUMENTS

| | | |
|---|---|---|
| WO | WO2010/040961 | 4/2010 |
| WO | WO2015/061834 | 5/2015 |
| WO | WO2016/160591 | 10/2016 |
| WO | WO2019/031779 | 2/2019 |
| WO | WO2019/175740 | 9/2019 |
| WO | WO2019/177616 | 9/2019 |
| WO | WO2020/041640 | 2/2020 |
| WO | WO2020/050823 | 3/2020 |
| WO | WO2020/077162 | 4/2020 |
| WO | WO2020/093058 | 5/2020 |
| WO | WO2020/099516 | 5/2020 |
| WO | WO2020/156847 | 8/2020 |
| WO | WO2020/157695 | 8/2020 |
| WO | WO2020/182854 | 9/2020 |
| WO | WO2020/201227 | 10/2020 |
| WO | WO2020/212426 | 10/2020 |
| WO | WO2020/227813 | 11/2020 |
| WO | WO2021/005428 | 1/2021 |
| WO | WO2021/005505 | 1/2021 |
| WO | WO2021/013370 | 1/2021 |
| WO | WO2021/014287 | 1/2021 |
| WO | WO2021/018740 | 2/2021 |
| WO | WO2021/018772 | 2/2021 |
| WO | WO2021/018775 | 2/2021 |
| WO | WO2021/019419 | 2/2021 |
| WO | WO2021/021095 | 2/2021 |
| WO | WO2021/053488 | 3/2021 |
| WO | WO2021/067412 | 4/2021 |
| WO | WO2021/068058 | 4/2021 |
| WO | WO2021/074726 | 4/2021 |
| WO | WO2021/074727 | 4/2021 |
| WO | WO2021/074728 | 4/2021 |
| WO | WO2021/080550 | 4/2021 |
| WO | WO2021/099323 | 5/2021 |
| WO | WO2021/099358 | 5/2021 |

OTHER PUBLICATIONS

International Search Report and Written Opinion for International Application No. PCT/US2020/049459, dated Dec. 8, 2020, 13 pages.

International Search Report and Written Opinion for International Application No. PCT/US2020/049453, dated Dec. 14, 2020, 13 pages.

* cited by examiner

TETHERED, HINGED CLOSURE

CROSS-REFERENCE TO RELATED PATENT APPLICATIONS

The present application is a continuation of International Application No. PCT/US2020/049493, filed Sep. 4, 2020, which claims the benefit of and priority to U.S. Application No. 62/900,917, filed Sep. 16, 2019, U.S. Application No. 62/897,005, filed Sep. 6, 2019, and U.S. Application No. 63/004,184, filed Apr. 2, 2020, and U.S. Application No. 63/023,543, filed May 12, 2020, each of which are incorporated herein by reference in their entirety.

BACKGROUND OF THE INVENTION

The present disclosure relates generally to the field of closures for containers. The present disclosure relates specifically to a closure for a container having a cap and a tab, with the tab maintaining the cap in an open position.

SUMMARY OF THE INVENTION

In one embodiment, this disclosure relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a first line of weakness that separates the cylindrical wall and the retention band, the plurality of frangible members extending across the first line of weakness and connecting the cylindrical wall and the retention band, the first line of weakness extending circumferentially around the closure from a first end to a second end, a second line of weakness, the second line of weakness including a tab portion and lateral section that extend from the tab portion, wherein the tab portion extends from the top panel a first distance and the lateral sections define a second distance from the top panel that is less than the first distance, and wherein the lateral sections are between the first end and the second end of the first line of weakness, a first tether that extends between the second line of weakness and the first end of the first line of weakness, and a second tether that extends between the second line of weakness and the second end of the first line of weakness.

In a specific embodiment, the closure is formed via injection molding. In a specific embodiment, the second line of weakness extends diagonally, thus both circumferentially away from the tab and vertically away from the top panel. In a specific embodiment, the first line of weakness defines a height from the top panel that is no shorter than the height of the lateral sections of the second line of weakness. In a specific embodiment, the tab portion defines an angle between 110 degrees and 160 degrees with respect to a connecting portion of the second line of weakness that extends from the tab portion. In a specific embodiment, the closure also includes an interference band that extends from the retention band inwardly towards the rotational axis, the interference band extending a first length from a base of the retention band at a first location beneath the tab, and the interference band extending a second length from the base of the retention band at a second location, the second location being opposite the first location with respect to the rotational axis, and the second length being greater than the first length. In a specific embodiment, the first length is less than 50% of a third length from a bottom of the retention band to a top of the retention band.

In another embodiment, this disclosure relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, two tethers that extend from the cylindrical wall, a retention band pivotally coupled to the cylindrical wall by the two tethers, the retention band attached to the bottom edge by a plurality of frangible members, the frangible members providing a visual indication, when broken, that the closure has been opened, a first line of weakness that separates the cylindrical wall and the retention band, wherein the plurality of frangible members extend across the first line of weakness and connect the cylindrical wall and the retention band, the first line of weakness extending circumferentially around the closure from a first end to a second end, and a second line of weakness, the second line of weakness including a tab portion that defines a first height from the top panel, first lateral sections that extend circumferentially away from the tab portion and that define a second height from the top panel less than the first height, and second lateral sections that extend circumferentially away from the first lateral sections portion and that define a third height from the top panel greater than the second height. A first tether of the two tethers is defined between the second line of weakness and the first end of the first line of weakness, and a second tether of the two tethers is defined between the second line of weakness and the second end of the first line of weakness.

In a specific embodiment, the first line of weakness defines a height from the top panel that is no shorter than the height from the first lateral sections of the second line of weakness. In a specific embodiment, the first line of weakness defines a height from the top panel that is equal to the height of the first lateral sections of the second line of weakness. In a specific embodiment, the tab portion defines an angle between 110 degrees and 160 degrees with respect to a connecting portion of the second line of weakness that extends from the tab portion. In a specific embodiment, the closure includes an interference band that extends from the retention band inwardly towards the rotational axis, the interference band extending a first length from a base of the retention band at a first location beneath the tab, and the interference band extending a second length from the base of the retention band at a second location, the second location being opposite the first location with respect to the rotational axis, and the second length being greater than the first length. In a specific embodiment, the first length is less than 60% of the second length. In a specific embodiment, the second line of weakness defines a first partition and a second partition, each of which extends towards the top panel, the first partition being located between the tab portion and the first tether, and the second partition being located between the tab portion and the second tether.

In yet another embodiment, this disclosure relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, two tethers that extend from the cylindrical wall, a retention band pivotally coupled to the cylindrical wall by the two tethers, the retention band being attached to the bottom edge by a plurality of frangible members, the frangible members providing a visual indication, when broken, that the closure has been opened, a first line of weakness that separates the cylindrical wall and the retention band a first distance from the top panel, the plurality of frangible members extending across the first line of weakness and connecting the cylindrical wall and the retention band, the first line of weakness extending circumferentially around the closure from a first end to a second end, and a second line of weakness, the second line of weakness including a tab portion that defines a first height from the top panel. The second line of weakness further includes first lateral sections that extend circumferentially away from the tab portion and that define a second height from the top panel less that is no greater than the first height. A first tether of the two tethers is defined between the second line of weakness and the first end of the first line of weakness, and a second tether of the two tethers is defined between the second line of weakness and the second end of the first line of weakness.

In a specific embodiment, the first line of weakness defines a height from the top panel that is no shorter than the height of the first lateral sections of the second line of weakness. In a specific embodiment, the tab portion defines an angle between 110 degrees and 160 degrees with respect to a connecting portion of the second line of weakness that extends from the tab portion. In a specific embodiment, the closure includes an interference band that extends from the retention band inwardly towards the rotational axis, the interference band extending a first length from a base of the retention band at a first location beneath the tab, and the interference band extending a second length from the base of the retention band at a second location, the second location being opposite the first location with respect to the rotational axis, and the second length being greater than the first length. In a specific embodiment, the second line of weakness defines a first partition and a second partition, each of which extends toward the top panel, wherein the first partition is located between the tab portion and the first tether, and the second partition is located between the tab portion and the second tether. In a specific embodiment, the closure is formed via injection molding.

In another embodiment, this disclosure relates to a closure for closing a container having a neck portion defining an opening to the container, with the neck portion including a mating sealing formation and a mating attachment formation, includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of first frangible members. A tab is formed at a hinge location from the band and extending from the lower edge of the skirt to a pair of first co-linear slits in the band separated by a second frangible member. The tab is bounded by a pair of second slits extending from the lower edge of the skirt to the pair of first co-linear slits, with each of the pair of second slits being separated from a respective first co-linear slit by a respective third frangible member. When the closure is applied to the neck portion of the container, the sealing formation engages the mating sealing formation, and the band engages the mating attachment formation to seal the container. When the cap is removed from the neck portion, all of the frangible members are broken. The band remains engaged with the mating attachment formation. The cap remains attached to the band at the hinge location, and the tab interacts with the mating attachment formation to maintain an open cap position, wherein the cap is retained displaced from the opening of the container.

In yet another embodiment, this disclosure relates to a closure for closing a container having a neck portion defining an opening to the container, with the neck portion including at least one neck thread and engagement ring, includes a cap having a top wall and a skirt perpendicular to the top wall and extending downwardly from the top wall to a lower edge of the skirt. The skirt includes an inner surface having at least one mating thread. A band is formed at the lower edge of the skirt. A plurality of first co-linear slits is separated by respective first frangible elements and defines a top edge of the band which extends to a lower edge of the band at which a retention ring for engaging the engagement ring is formed. A tab is formed from the band and extends from the top edge of the band to a pair of second co-linear slits in the band separated by a second frangible element. The tab is bounded by a pair of third slits extending between respective first co-linear slits and respective second co-linear slits. A first hinge portion extends between one of the respective first co-linear slits and third slits, and a second hinge portion extends between the other of the respective first co-linear slits and third slits. Each of the third slits is separated from a respective second slit by a respective third frangible element. When the closure is applied to the neck portion of the container, the mating thread engages the neck thread, and the retention ring engages the engagement ring to seal the container. When the cap is removed from the neck portion, all of the frangible elements are broken. The band remains engaged with the mating attachment formation, and the cap remains attached to the band by the first and second hinge portions. The tab interacts with the engagement ring to maintain an open cap position wherein the cap is retained displaced from the opening of the container.

In yet another embodiment, this disclosure relates to a closure for closing a container having a neck portion defining an opening to the container, with neck portion including a mating sealing formation and a mating attachment formation, includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of first frangible members. A tab is formed at a hinge location from the band and extends from the lower edge of the skirt to a pair of first co-linear slits in the band separated by a second frangible member. The tab is bounded by a pair of second slits extending from the lower edge of the skirt to the pair of first co-linear slits, and each of the pair of second slits is separated from a respective first co-linear slit by a respective third frangible member to form a shape of a trapezoid. Each of the second slits forms an angle from 40° to 50° with the lower edge of the skirt relative to a horizontal axis. When the closure is applied to the neck portion of the container, the sealing formation engages the mating sealing formation, and the band engages the mating attachment formation to seal the container. When the cap is removed from the neck portion, all of the frangible members are broken. The band remains engaged with the mating attachment formation. The cap remains attached to the band at the hinge location, and the tab interacts with the mating attachment formation to maintain an open cap position wherein the cap is retained displaced from the opening of the container.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

DETAILED DESCRIPTION

Figure 1:
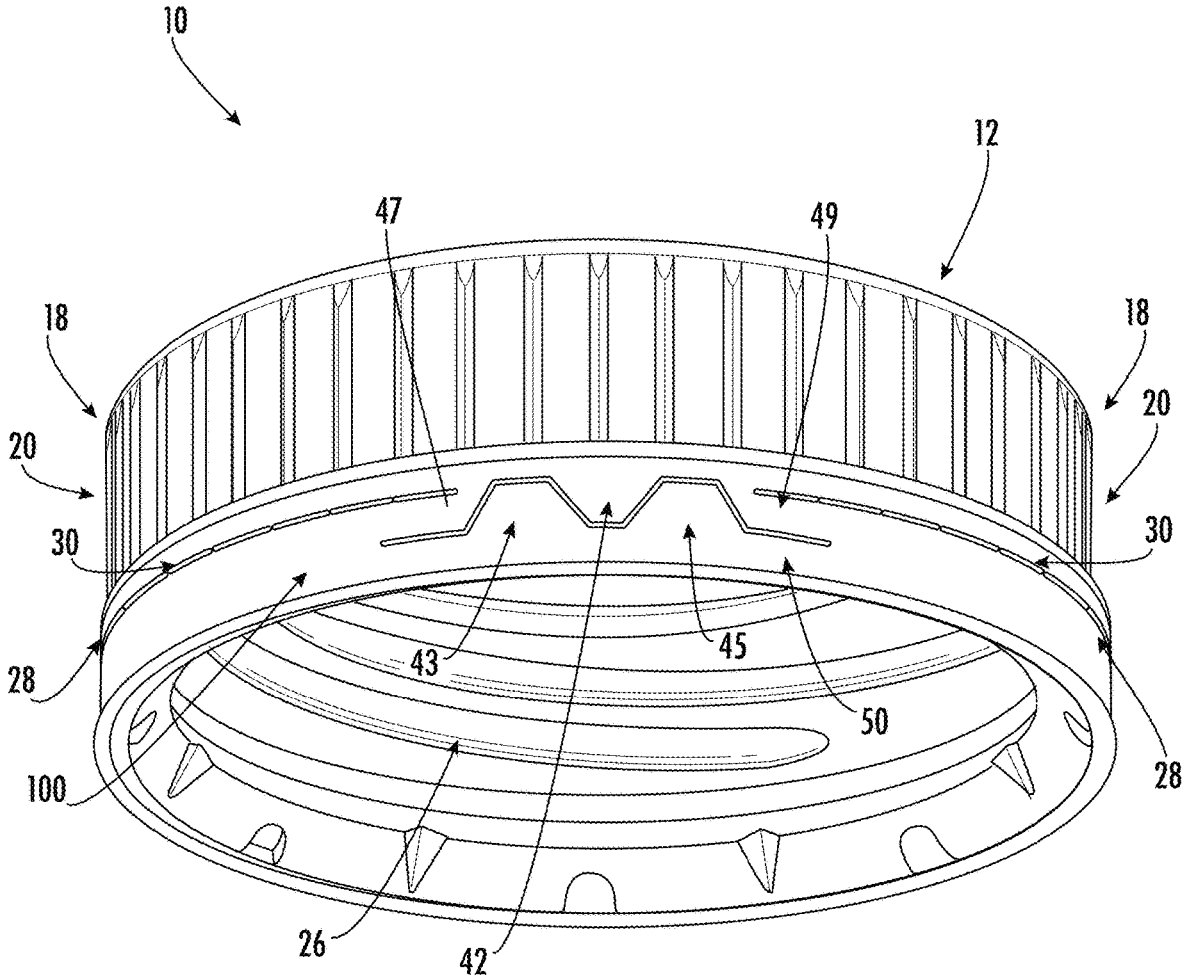
FIG. 1 is a perspective view of a closure, according to an exemplary embodiment.

Referring first to FIGS. 1-12, in an embodiment, a closure 10 for closing a container 180 is shown. The closure 10 includes a top panel 12 and a cylindrical wall, shown as skirt 20, perpendicular to the top wall 12. The skirt 20 extends downwardly from a bottom surface 16 of an outer periphery 18 of top wall 12. The skirt extends away from opposing upper surface 14 of top wall 12 to a lower edge 28 of skirt 20.

A first line of weakness, such as an upper weakened section, shown as a upper slit 30, includes one or more frangible connections 38 that couple body 48 to retaining band 100. When closure 10 is initially opened, frangible connections 38 break, thus providing a visual indication that closure 10 has been opened. Upper slit 30 separates body 48 of closure 10 from a retention band, shown as retaining band 100. Upper slit 30 extends circumferentially around closure 10 from first end 32 to second end 34. Angle 36 is defined as angular separation of first end 32 from second end 34 with respect to rotational axis 8 of closure 10. In various embodiments, the top panel 12 is centered about axis 8.

A second line of weakness, such as a lower weakened section, shown as lower slit 50, together with upper slit 30 forms various features in closure 10. As is described in more detail below, tab 42 extends from body 48 of closure 10 towards retaining band 100. Connecting portions, shown as left tether 47 and right tether 49, are defined between upper slit 30 and lower slit 50 and extend between body 48 and retaining band 100.

Left partition 43 is between left tether 47 and tab 42. Left partition 43 extends above the lower portions of lower slit 50. Similarly, right tether 49 is separated from tab 42 by right partition 45, which extends above the lower portions of lower slit 50. Left partition 43 and right partition 45 provide for increased independent twisting of tab 42 relative to left and right tethers 47, 49 compared to embodiments in which left and right tethers 47, 49 extend directly into tab 42 without intervening partitions. Left tether 47 is defined between lower slit 50 and first end 32 of upper slit 30, and right tether 49 is defined between lower slit 50 and second end 34 of upper slit 30.

As will be described in more detail below, when closure is opened for the first time, body 48 of closure 10 pivots around hinge 41 away from the container neck and the retaining band 100. Body 48 remains coupled to retaining band 100 via left tether 47 and right tether 49. As body 48 pivots away from the container neck, tab 42 pivots towards the container neck. Tab 42 is positionable to interface against the container neck and to bias body 48 of closure 10 away from the container neck, thus allowing a user to drink from the container neck with little to no interference from body 48 of closure 10.

Figure 2:
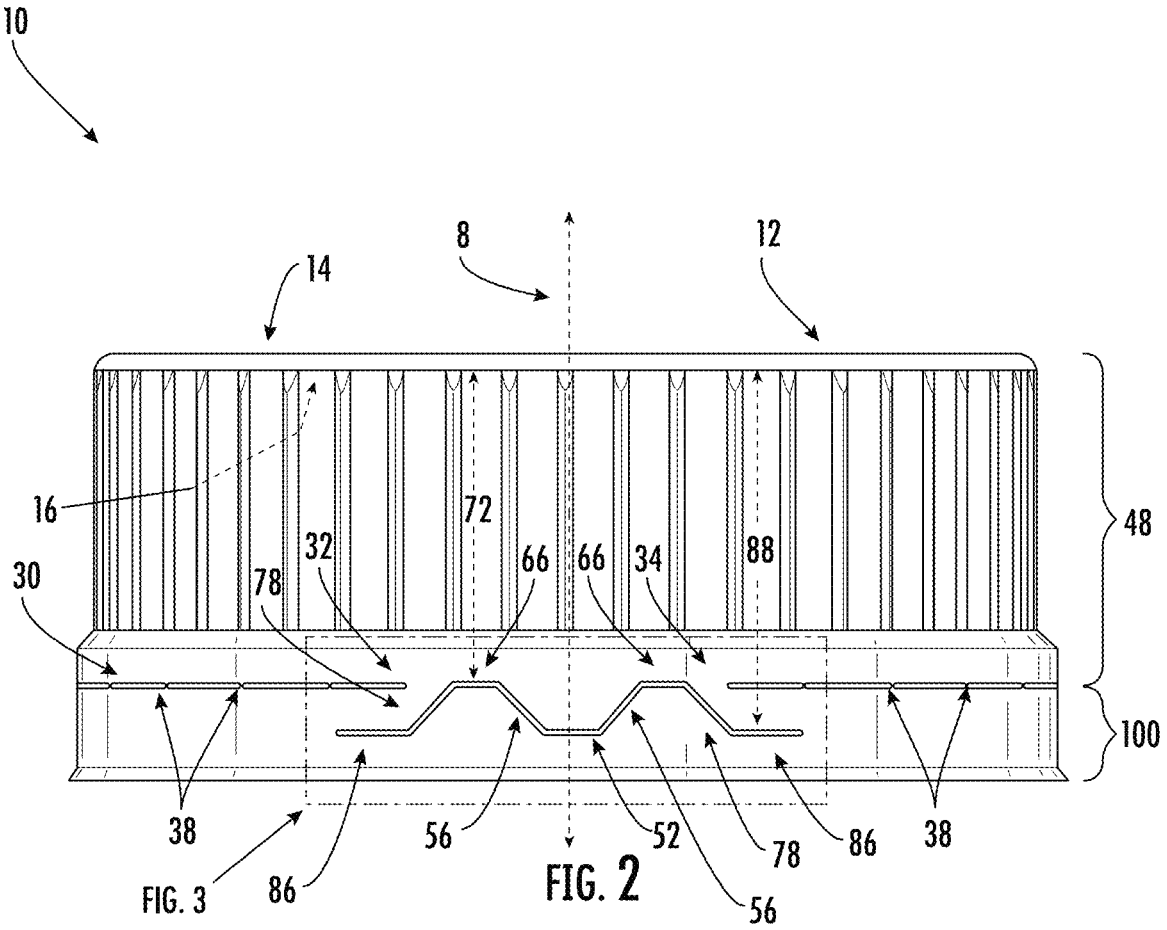
FIG. 2 is a back view of the closure of FIG. 1, according to an exemplary embodiment.
Figure 3:
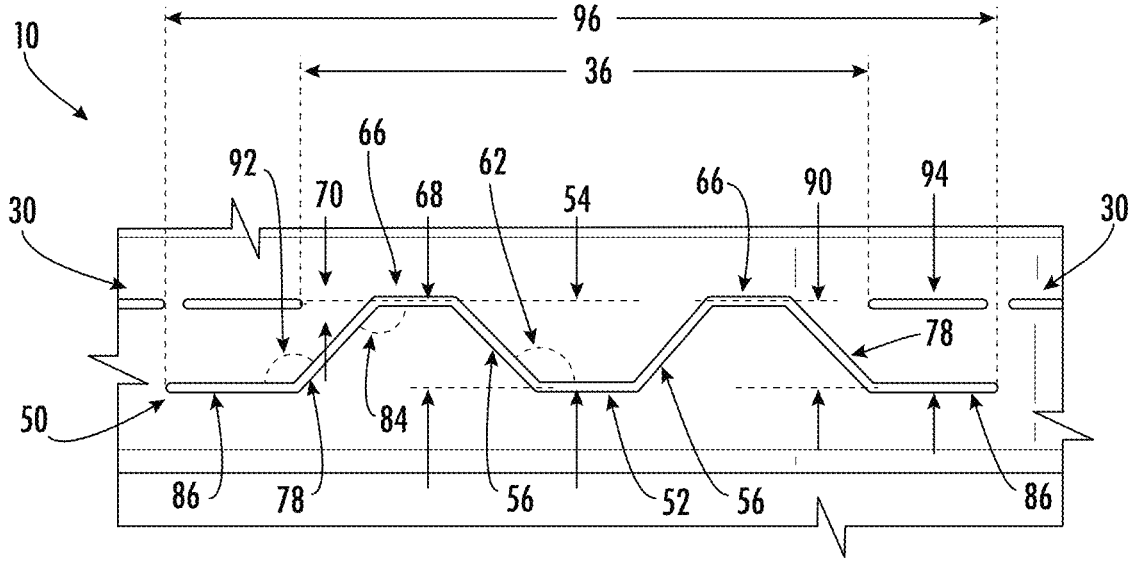
FIG. 3 is a detailed back view of the closure of FIG. 1, according to an exemplary embodiment.
Figure 4:
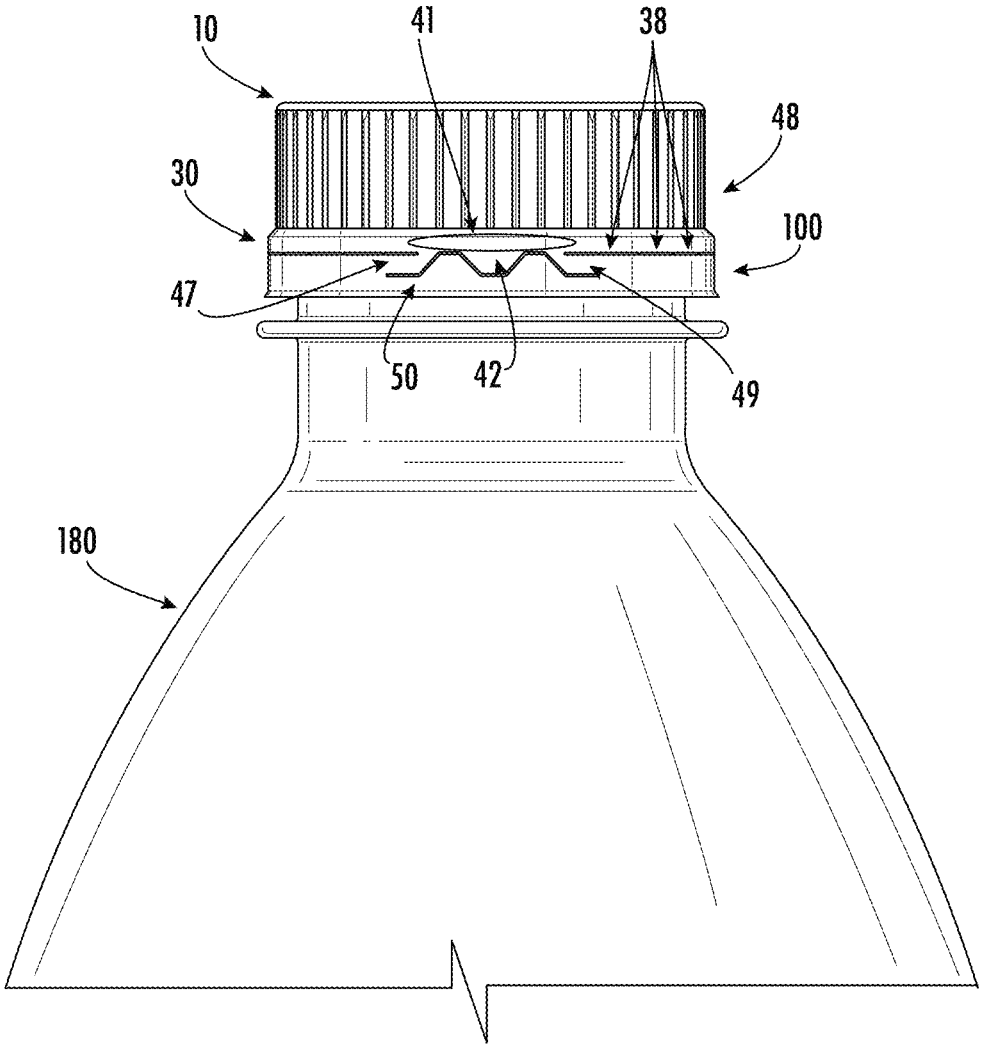
FIG. 4 is a back view of the closure of FIG. 1 on a container, according to an exemplary embodiment.

Turning to FIGS. 2 and 3 in particular, in a specific embodiment lower slit 50 is formed by a series of portions that extend circumferentially around closure 10 at varying distances from top panel 12. In a specific embodiment, tab 42 of lower slit 50 is defined by central portion 52 and upper portions 66. Central portion 52 is a distance 54 from upper slit 30. Inner connecting portions 56 of lower slit 50 extend from either end of central portion 52 at angle 62 towards upper portions 66. Lateral portions, shown as upper portions 66 extend circumferentially about closure and are height 68 above central portion 52 and height 70 above upper slit 30. In a specific embodiment, upper portions 66 are a smaller distance from top panel 12 than central portion 52. In a specific embodiment, upper portions 66 are between first end 32 and second end 34 of upper slit 30 (shown FIG. 3).

In the specific embodiment shown in FIGS. 2 and 3, upper portions 66 are aligned with upper slit 30, so the height 70 is 0 (zero). In a specific embodiment, upper slit 30 is at least as far from top panel 12 as upper portions 66.

Upper portions 66 are height 72 below lower surface 16 of top panel 12. Outer connecting portions 78 of lower slit 60 extend from upper portions 66 at angle 84. Outer portions 86 of lower slit 60 extend from outer connecting portions 78 at angle 92. Outer portions 86 are height 94 below upper slit 30, outer portions 86 are height 88 from lower surface 16 of top panel 12, and outer portions 86 are height 90 from upper portions 66. Lower slit 50 extends angle 96 circumferentially around closure 10 with respect to axis 8. In a specific embodiment, outer portions 86 are a greater distance from top panel 12 than upper portions 66.

In various embodiments angle 62, angle 84 and angle 92 each define an angle between 110 degrees and 160 degrees, and more specifically between 120 degrees and 150 degrees, and more specifically between 130 degrees and 140 degrees, and more specifically 135 degrees. Thus, in various embodiments the tab portion defines an angle between 110 degrees and 160 degrees with respect to a connecting portion of the second line of weakness that extends from the tab portion, and more specifically an angle of 135 degrees. In various embodiments, angle 62, angle 84 and angle 92 are equal with each other. In various other embodiments, at least one of angle 62, angle 84 and angle 92 are different from the other angles. In various embodiments, tab 42 includes angle 62.

In various embodiments, lower slit 50 does not include frangible members 38. In various other embodiments, lower slit 50 includes frangible members 38.

Figure 6:
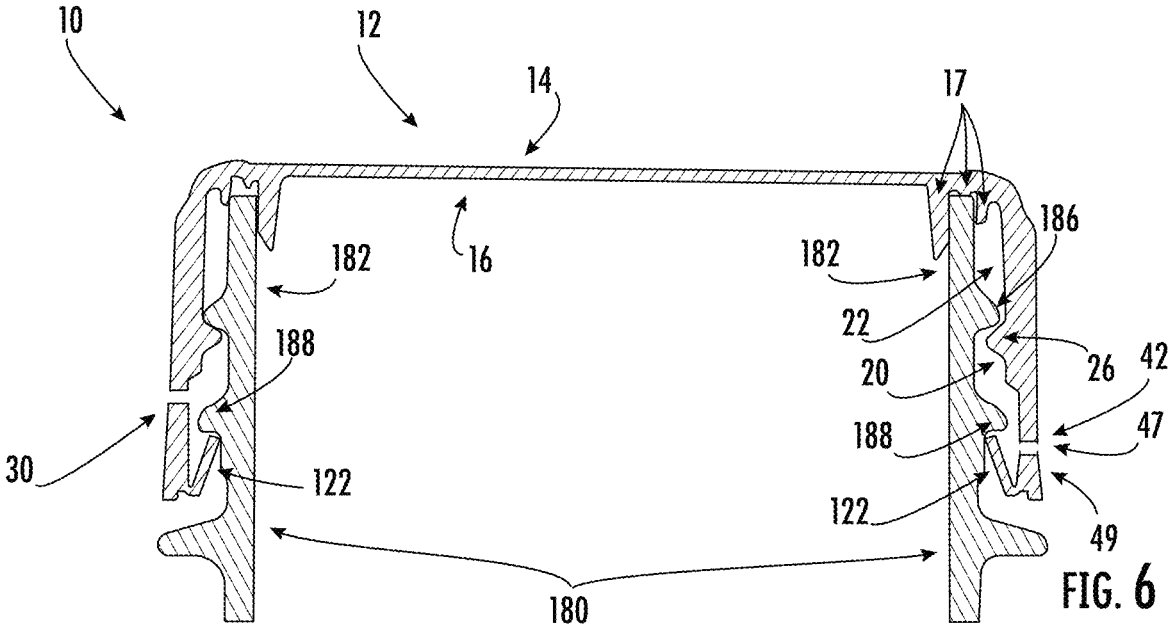
FIG. 6 is a cross-section view of the closure of FIG. 5 on a container taken along line 6-6 in FIG. 5, according to an exemplary embodiment.

Turning to FIG. 6, the interaction between the J-band and the container neck will be described. The container 180 includes a neck portion 182 defining an opening to the container 180. The neck portion 182 includes a mating sealing formation/neck thread 186. The skirt 20 includes an inner surface 22 having a sealing/mating formation, shown as thread 26, to mate with the mating sealing formation/neck thread 186 of container 180. The closure 10 includes one or more sealing formations, shown as rings 17, that interface with neck portion 182 of container 180 to provide a fluid seal between closure 10 and container 180.

A retaining tamper-evidencing band, shown as band 100, includes at least one radially inwardly projecting retaining element, shown as a J-band 122. J-band 122 is attached at a lower end to the inner surface of the tamper band via a J-band hinge. An upper, free end of the J-band is defined by an engagement surface. The retaining elements include a plurality of structures (e.g. beads, tabs, flanges) projecting radially inwards from the inner surface of band 100 and engaging a corresponding retaining structure, such as annular projection 188 that extends from neck portion 182 of container 180.

When the closure 10 is applied to the neck portion 182 of the container 180, the sealing formation/mating thread 186 of container 180 engages the mating sealing formation/neck thread 26 of closure 10. One or more of rings 17 engage the mating attachment formation of container neck 182 to seal the container 180. When the closure 10 is removed from the neck portion 182, most or all of the frangible members 38 are broken, and the retaining band 100 remains engaged with the container neck 182. The body 48 of closure 10 remains attached to the retaining band 100 via left tether 47 and right tether 49. The tab 42 interacts with the mating attachment formation to maintain an open cap position wherein the body 48 of closure 10 is retained displaced from the opening of the container 180. In a specific embodiment, when body 48 of closure 10 is removed from neck portion 182, at least one of frangible members 38 break while at least one of frangible members 38 remain unbroken.

The tab 42 interacts with the mating attachment formation/engagement ring of the container neck to maintain an open cap position wherein the body 48 of closure 10 is retained displaced from the opening of the container 180. The left tether 47 and right tether 49 bias the tab 42 inward towards the neck portion 182 of the container 180, working together with the tab 42 to keep the body 48 in the open cap position on an angle θ (e.g., from 90° to) 135°. In a specific embodiment, the tab 42 contacts the neck thread 26 while the body 48 is in the open cap position.

Figure 5:
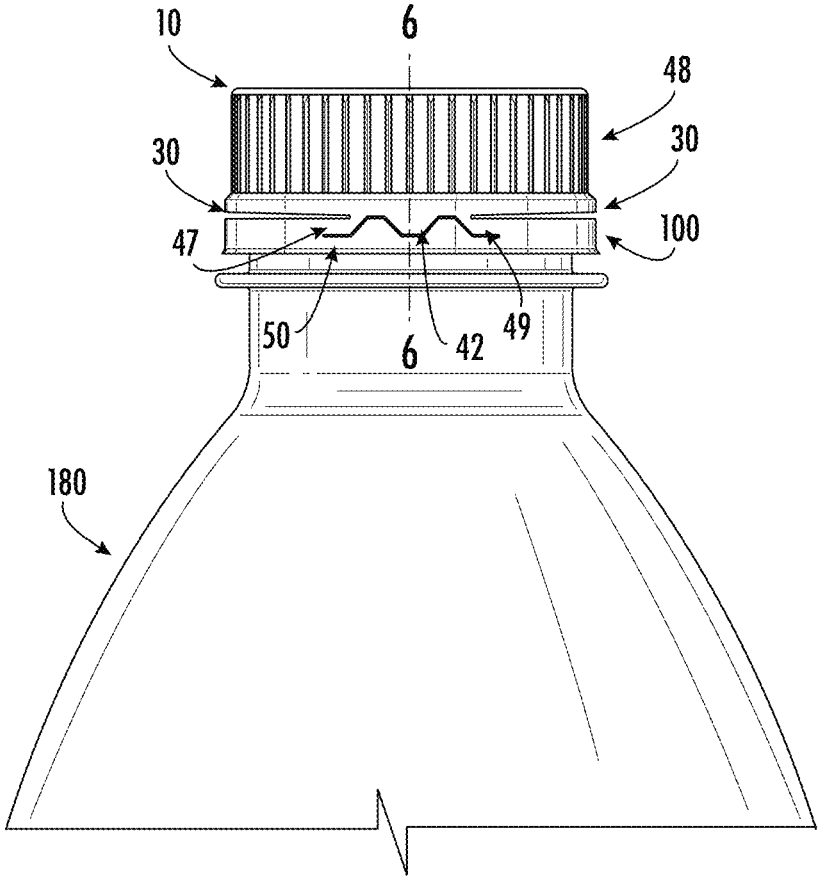
FIG. 5 is a back view of the closure of FIG. 1 on a container shown in a different configuration than shown in FIG. 4, according to an exemplary embodiment.

Turning to FIGS. 5-12, the opening of closure 10 relative to neck portion 182 of container 180 is depicted. FIGS. 5-6 depict closure 10 at the moment that most and/or all of frangible connections 38 have broken. Sealing rings 17 of body 48 are still sealed with neck portion 182. FIG. 6 depicts a cross-section of the portion of closure 10 and container 180 identified in FIG. 5. Left tether 47 and right tether 49 are shown in dotted line in FIG. 6, because they are not located along the cross-section line identified in FIG. 5. Left tether 47 and right tether 49 are located to either side of the cross-section line identified in FIG. 5.

Figure 7:
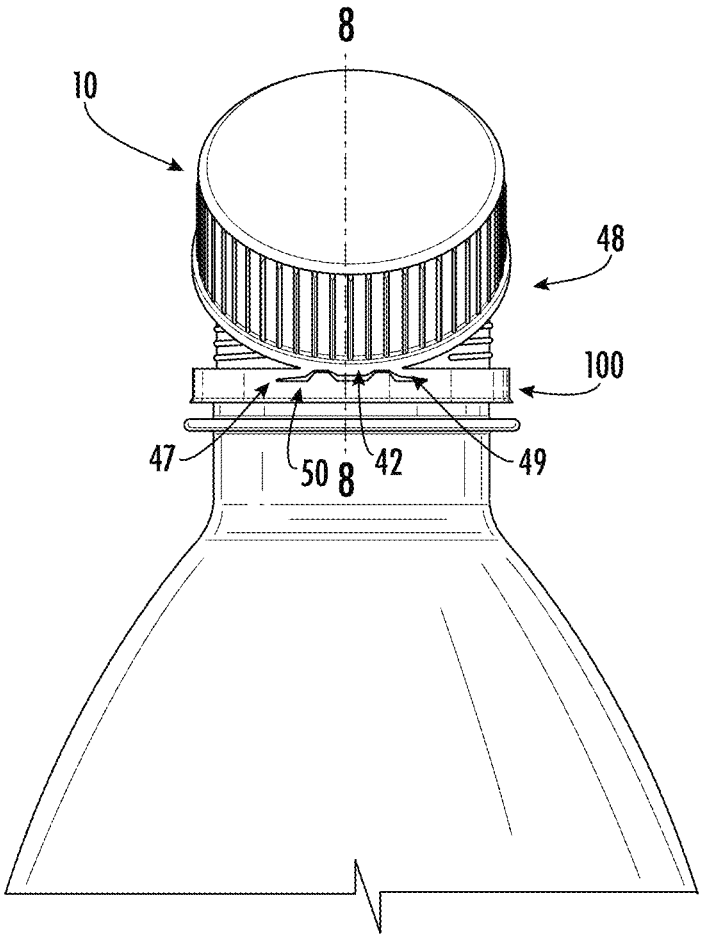
FIG. 7 is a back view of the closure of FIG. 1 on a container shown in a different configuration than shown in FIG. 5, according to an exemplary embodiment.
Figure 8:
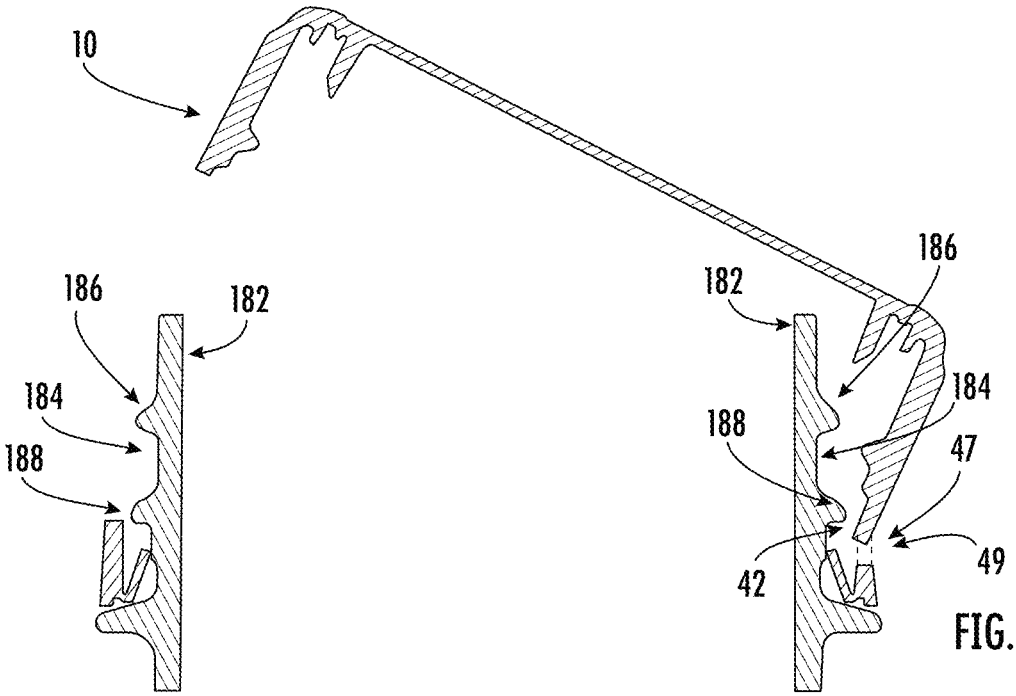
FIG. 8 is a cross-section view of the closure of FIG. 7 on a container taken along line 8-8 in FIG. 7, according to an exemplary embodiment.

Turning to FIGS. 7-8, body 48 of closure 10 is starting to pivot away from neck portion 182 of container 180. Body 48 remains coupled to retaining ring 100 via left tether 47 and right tether 49. Similar to FIGS. 5-6, left tether 47 and right tether 49 retain the coupling between body 48 and retaining band 100 and are shown in dotted line in FIG. 8. Tab 42 is starting to pivot towards container 180 but not yet interfacing with container 180.

Figure 9:
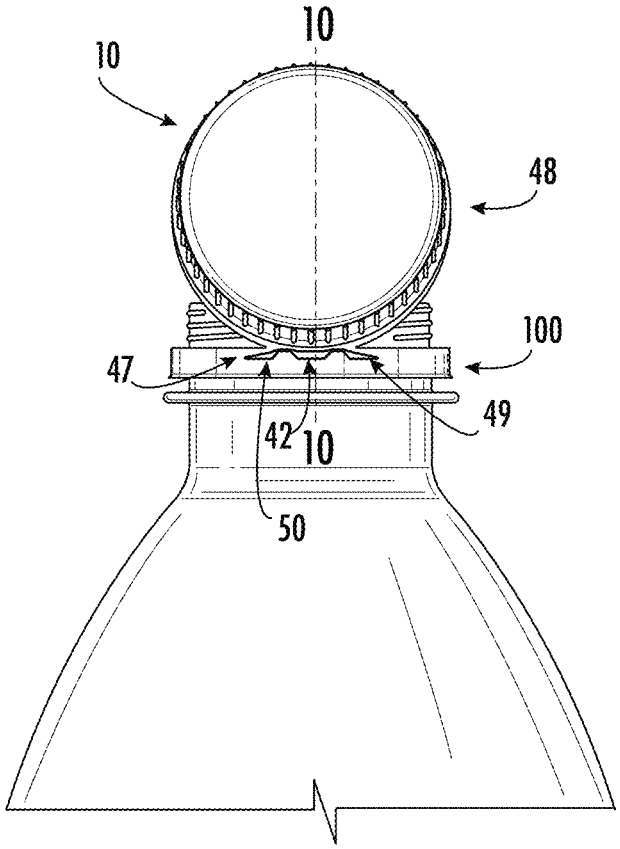
FIG. 9 is a back view of the closure of FIG. 1 on a container shown in a different configuration than shown in FIG. 7, according to an exemplary embodiment.
Figure 10:
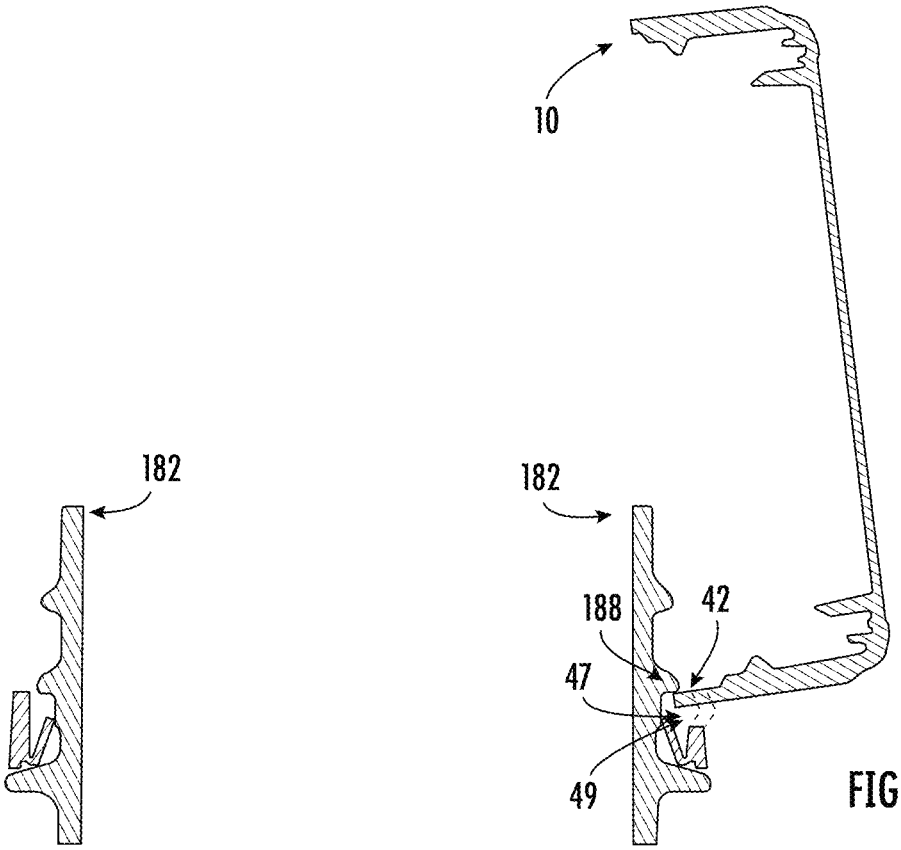
FIG. 10 is a cross-section view of the closure of FIG. 9 on a container taken along line 10-10 in FIG. 9, according to an exemplary embodiment.

Turning to FIGS. 9-10, body 48 of closure 10 is pivoted approximately halfway open from neck portion 182. Tab 42 is now interfacing against the bottom of annular projection 188 of container 180. Similar to FIGS. 5-8, left tether 47 and right tether 49 retain the coupling between body 48 and retaining band 100 and are shown in dotted line in FIG. 10.

Figure 11:
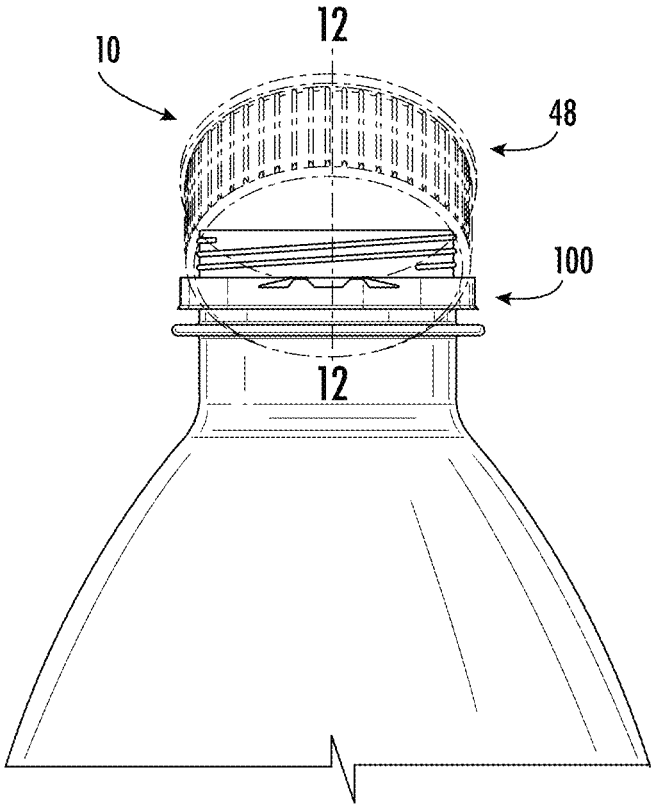
FIG. 11 is a back view of the closure of FIG. 1 on a container shown in a different configuration than shown in FIG. 9, according to an exemplary embodiment.
Figure 12:
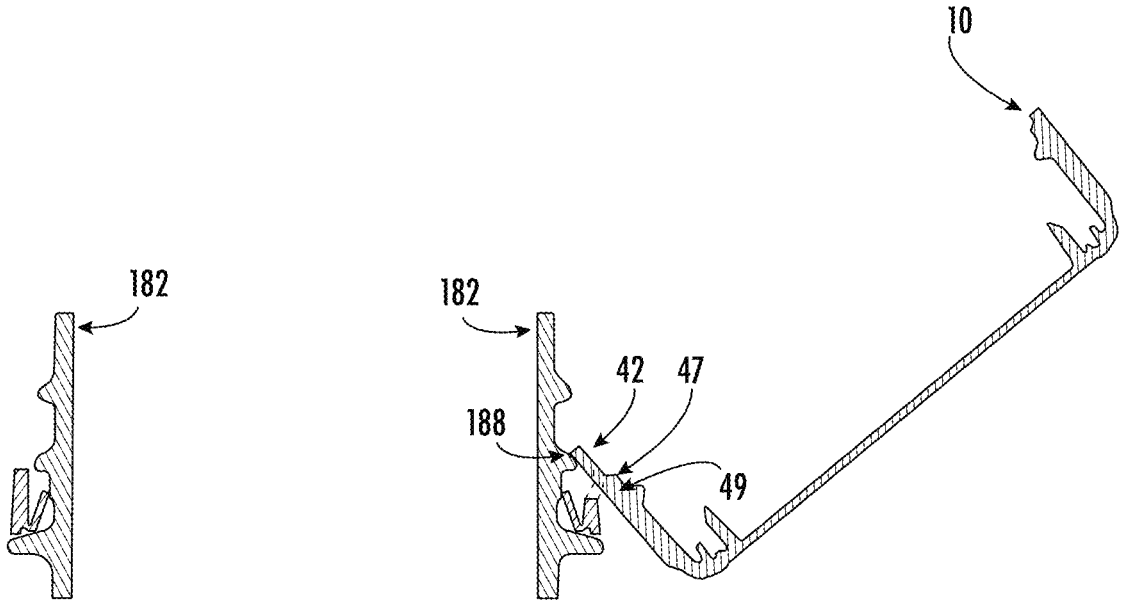
FIG. 12 is a cross-section view of the closure of FIG. 11 on a container taken along line 11-11 in FIG. 11, according to an exemplary embodiment.

Turning to FIGS. 11-12, body 48 of closure 10 is pivoted to the open position. Tab 42 is now interfacing against the upper portion of annular projection 188 of container 180. Tab 42 interfacing against annular projection 188 of container 180 biases body 48 of closure 10 away from neck portion 182. Similar to FIGS. 5-10, left tether 47 and right tether 49 retain the coupling between body 48 and retaining band 100 and are shown in dotted line in FIG. 12 because they are not located along the cross-section line identified in FIG. 11.

Figure 13:
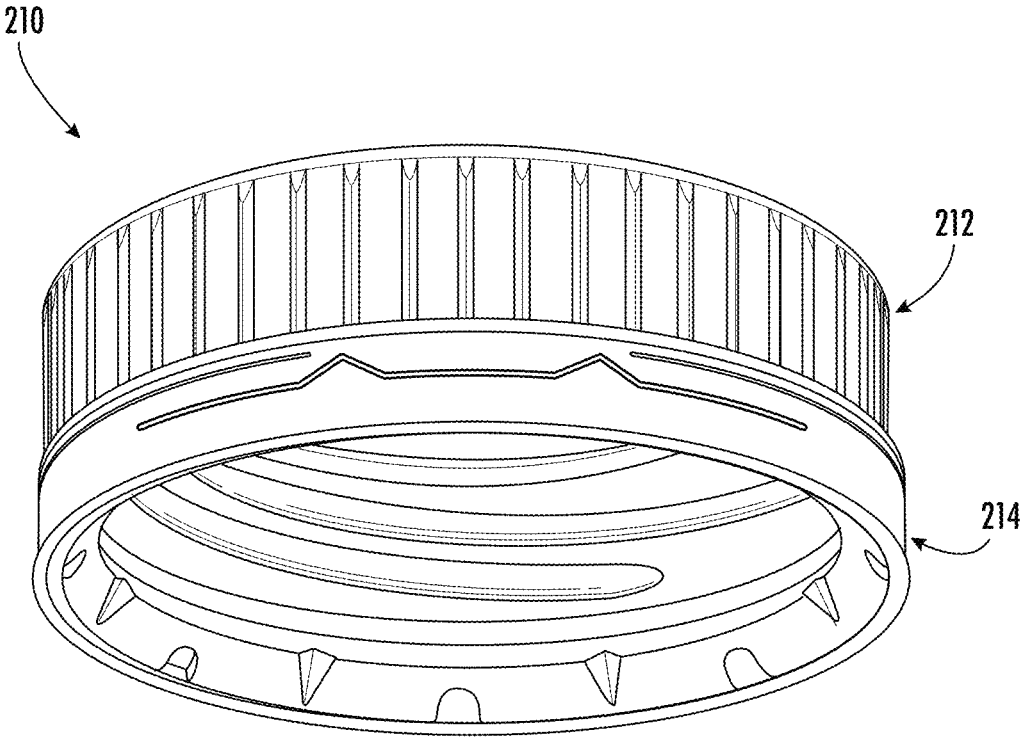
FIG. 13 is a perspective view of a closure, according to an exemplary embodiment.
Figure 14:
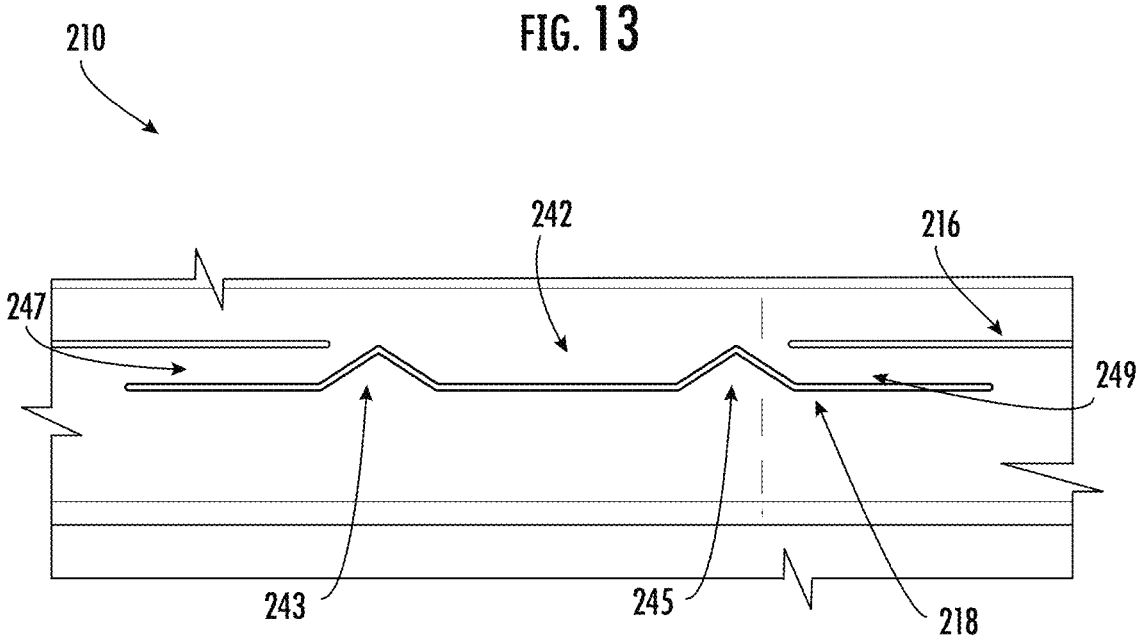
FIG. 14 is a detailed back view of the closure of FIG. 13, according to an exemplary embodiment.

Turning to FIGS. 13-14, various aspects of closure 210 are shown. Closure 210 is similar to closure 10 except as described herein. Body 212 of closure 210 is separated from retaining band 214 by upper slit 216 and lower slit 218. The lower slit 218 separates the tab 242 (centrally located between the left and right tethers 247, 249) and left and right tethers 247, 249 hinges from the retaining band 214. In a specific embodiment the lower slit 218 includes two partitions, shown as triangular shapes 243, 245, that extend from the lower slit 218 towards the top panel of the closure 210. The tab 242 is between the two partitions, and the hinges between body 212 and retaining band 214 are on either side of the projections. Applicant has observed that when the closure is in the opened position the tab 242 interfaces against the container neck to bias the annular wall and top panel away from the container neck. As closure 210 is opened, body 212 pivots with respect to retaining band 214.

Figure 15:
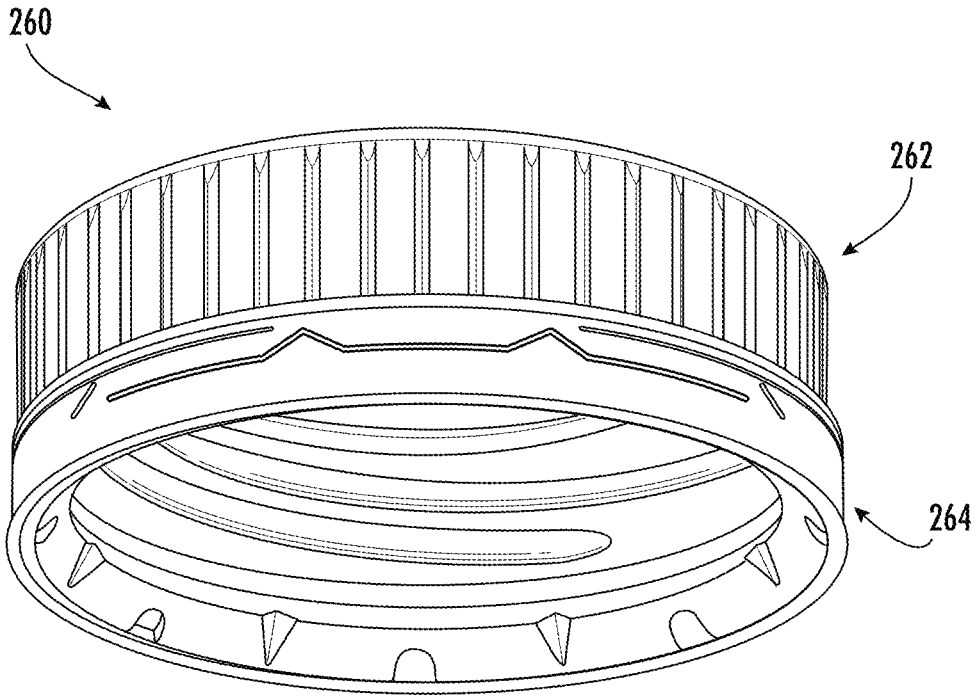
FIG. 15 is a perspective view of a closure, according to an exemplary embodiment.
Figure 16:
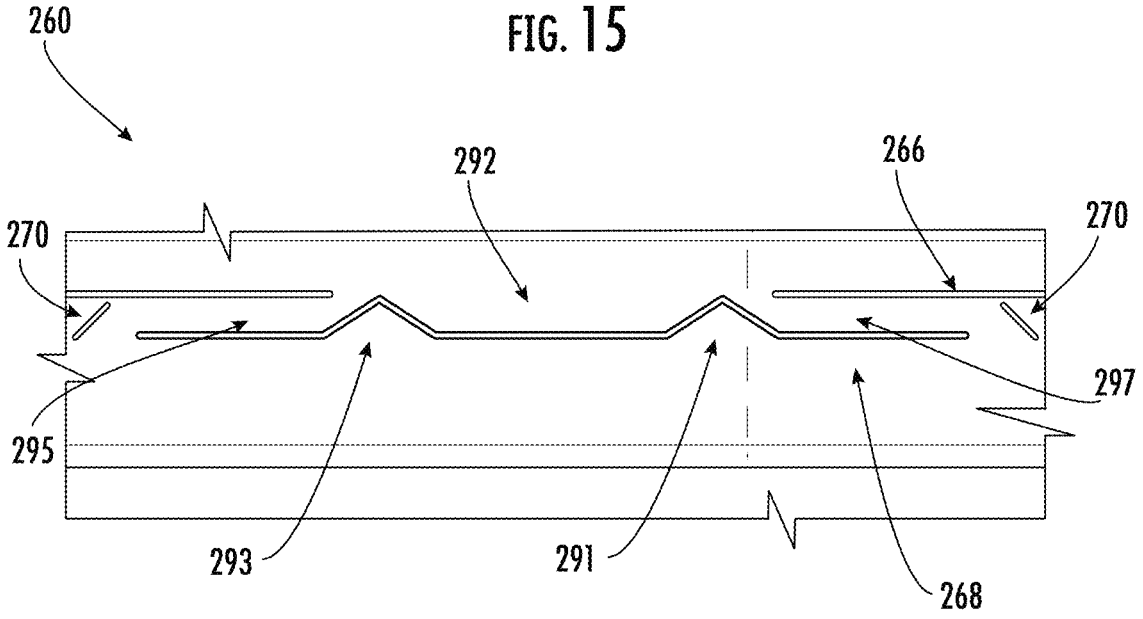
FIG. 16 is a detailed back view of the closure of FIG. 15, according to an exemplary embodiment.

Turning to FIGS. 15-16, various aspects of closure 260 are shown. Closure 260 is similar to closure 10, closure 210 and the other closures except as described herein. Body 262 of closure 260 is separated from retaining band 264 by upper slit 266 and lower slit 268. The upper slit 266 of the closure 260 includes one or more additional projections compared to the closure in FIGS. 13-14, shown as slits 270. Slits 270 extend downwardly from upper slit 266 towards lower slit 268 but not connected with the lower slit 268. In a specific embodiment two slits 270 extend from upper slit 266 on either side of left and right tethers 295, 297. In a specific embodiment the slits 270 extend downwardly from the upper slit 266 at angle away from each other (e.g., away from the centrally-located tab 292). In a specific embodiment, the lower slit 268 includes two partitions, shown as triangular shapes 291, 293, that extend from the lower slit 268 towards the top panel of the closure 260.

Figure 17:
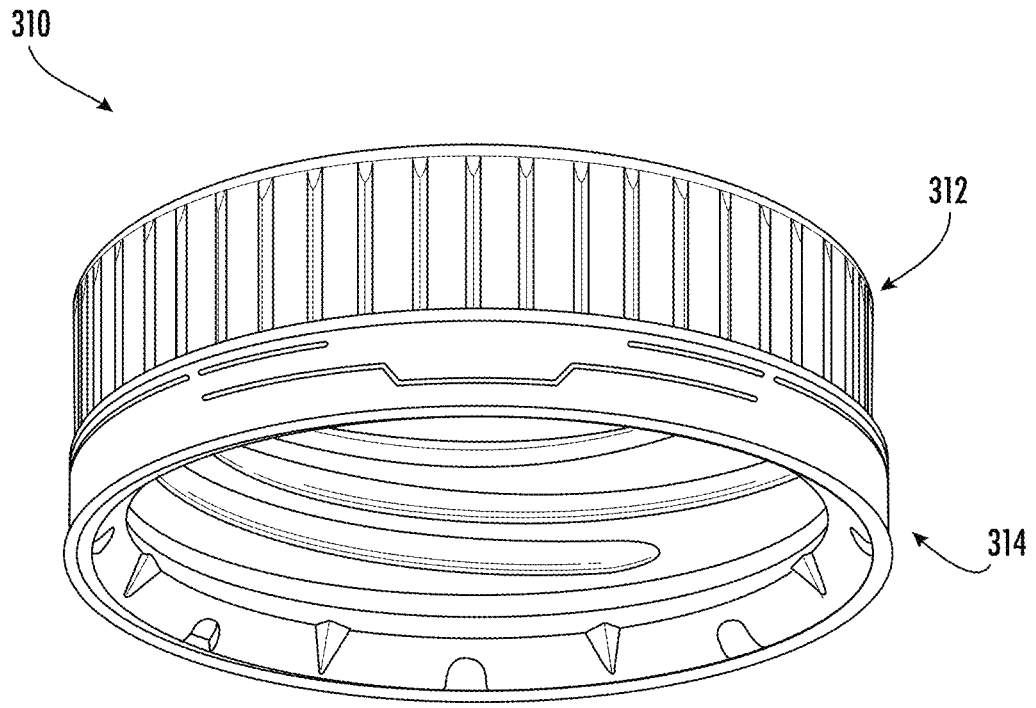
FIG. 17 is a perspective view of a closure, according to an exemplary embodiment.
Figure 18:
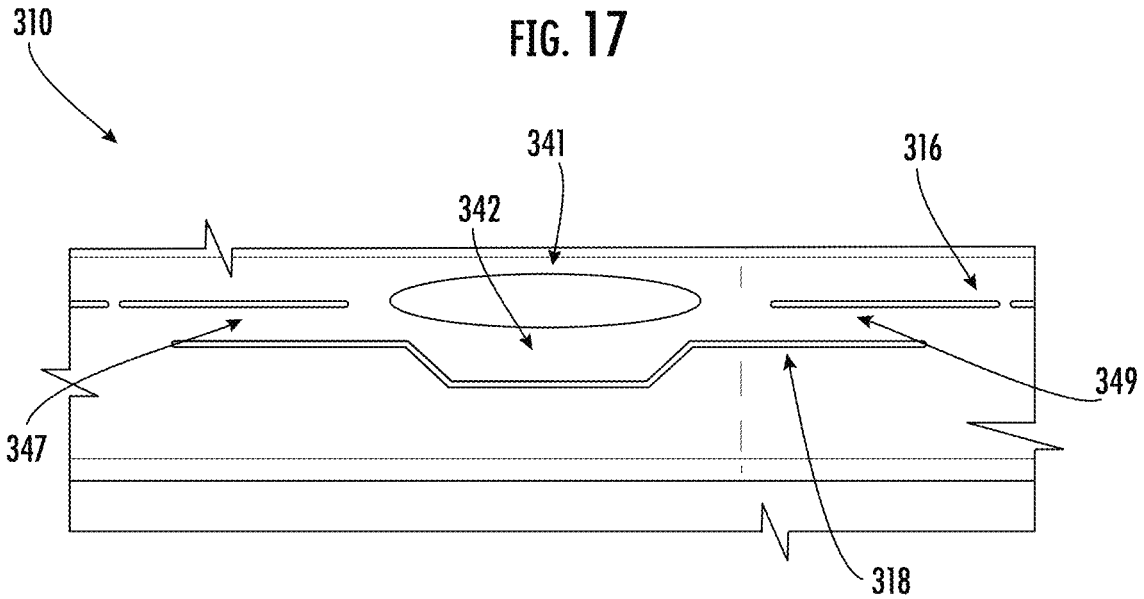
FIG. 18 is a detailed back view of the closure of FIG. 17, according to an exemplary embodiment.

Turning to FIGS. 17-18, various aspects of closure 310 are shown. Closure 310 is similar to closure 10, closure 210 and the other closures except as described herein. Body 312 of closure 310 is separated from retaining band 314 by upper slit 316 and lower slit 318.

Upper slit 316 extends circumferentially around closure 310 such that opposing ends of upper slits 316 define hinge 341. Body 312 pivots with respect to retaining band 314 around the hinge 341. The tab 342 extends from the hinge 341 in a direction away from the top panel (when closure 310 is in its original and unbroken configuration). In a specific embodiment the lower slit 318 is not interrupted by (e.g., they do not include) frangible connections.

In a specific embodiment, height between upper slits 316 and the top surface of top panel is 0.435 inches, the height between the higher portions of lower slit 318 and the top surface of top the panel is 0.521 inches, and the height between the lower portion of lower slit 318 and the top surface of the top panel is 0.565 inches. The width between ends of upper slit 316 is 0.452 inches circumferentially around band 314. Diagonal slits extend from the lower portion of lower slit 318 to the upper portions of lower slit 318. The diagonal slits extend from the horizontal slits (as shown in FIG. 18) at 60 degree angles. In a specific embodiment the height between upper slit 316 and the upper portions of lower slit 318 is 0.041 inches, the height between the upper and lower portions of lower slit 318 is 0.039 inches, and the height between the lower slit 318 and bottom of band 314 is 0.061 inches.

It is contemplated herein that slits 316, 318 in closure 310 may be formed such as, for exemplary purposes only and without limitation, via being slit open by a cutting device from a fully formed closure, being molded into the final form, being injection molded into the final form, and/or being molded to include one or more of the slits and a blade being used to cut the remaining one or more slits.

Figure 19:
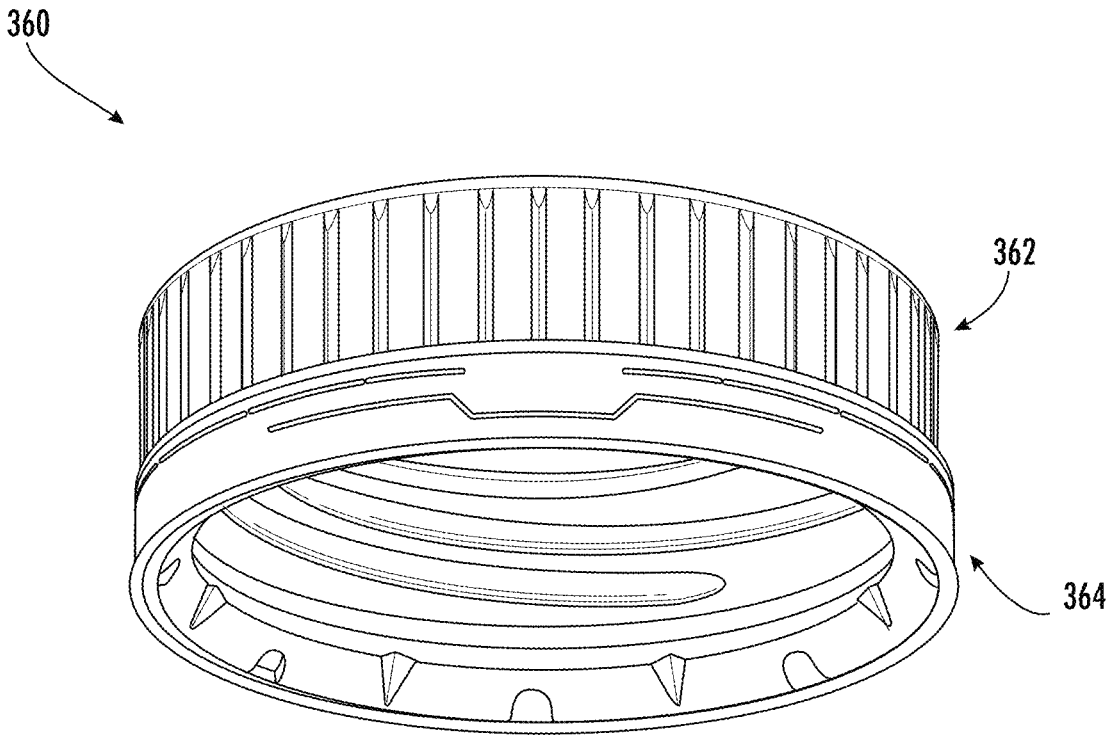
FIG. 19 is a perspective view of a closure, according to an exemplary embodiment.
Figure 20:
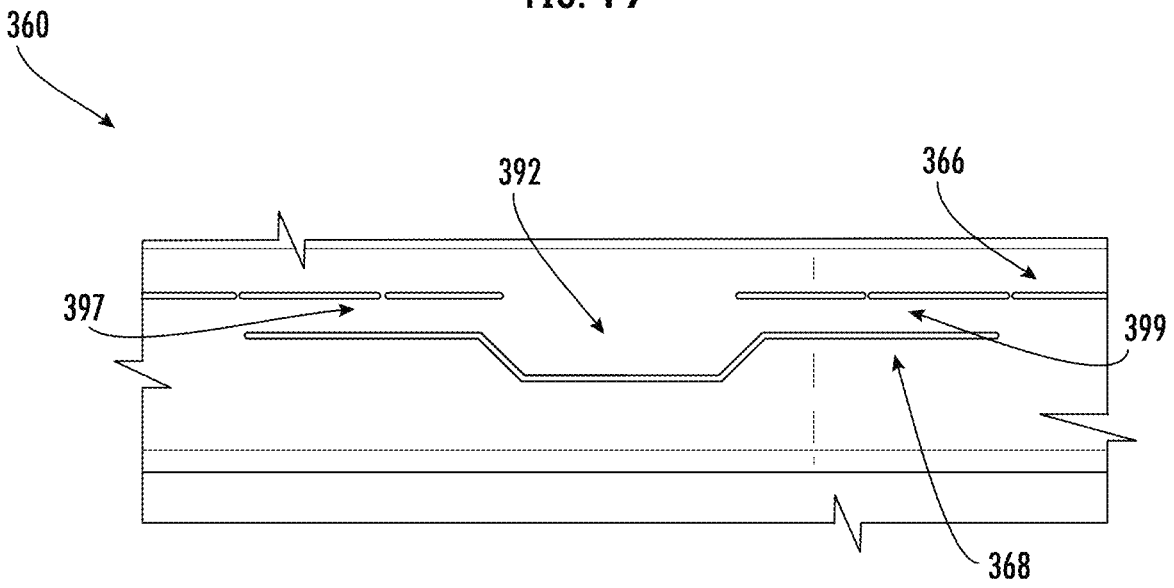
FIG. 20 is a detailed back view of the closure of FIG. 19, according to an exemplary embodiment.

Turning to FIGS. 19-20, various aspects of closure 360 are shown. Closure 360 is similar to closure 10, closure 210 and the other closures except as described herein. Body 362 of closure 360 is separated from retaining band 364 by upper slit 366 and lower slit 368. Body 362 is pivotally coupled to retaining band 364 via left and right tethers 397, 399. Tab 392 extends from body 362 away from top panel of closure 360. The ends of upper slit 366 of closure 360 are circumferentially separated by a width approximately equal to a width of tab 392. As a result, left and right tethers 397, 399 form a more unified connection to body 362 compared to closure 310, in which left and right tethers 347, 349 are more separated (best shown FIGS. 17-18).

Figure 21:
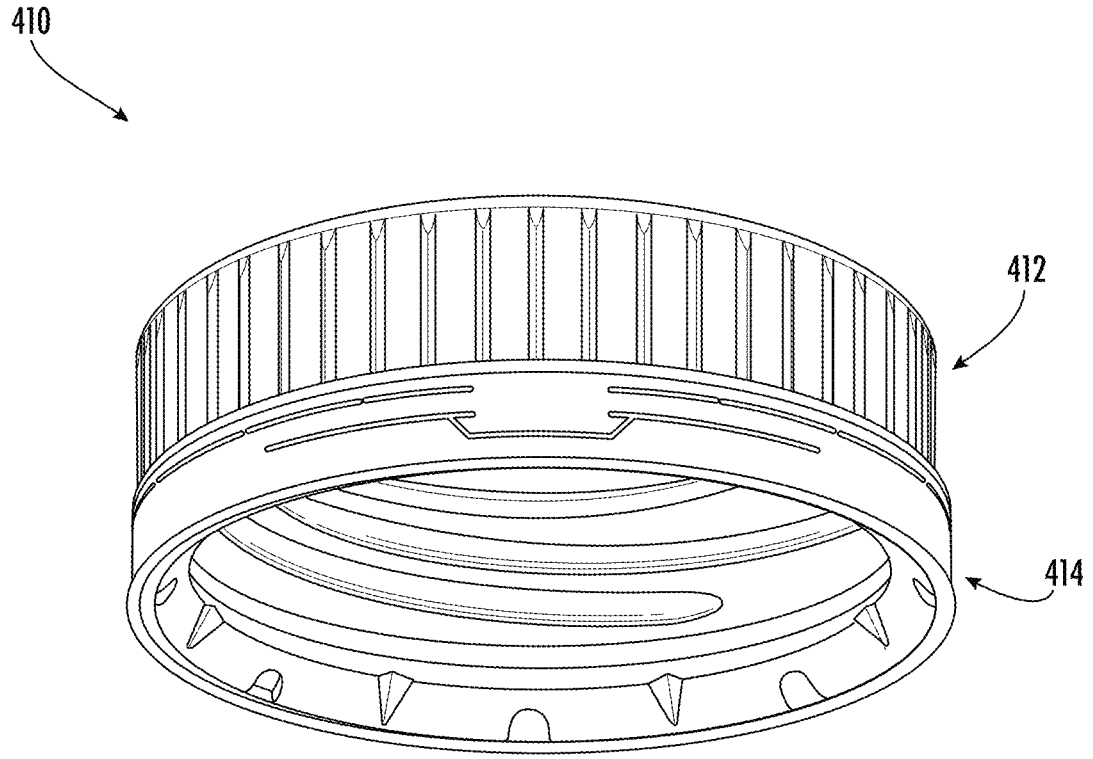
FIG. 21 is a perspective view of a closure, according to an exemplary embodiment.
Figure 22:
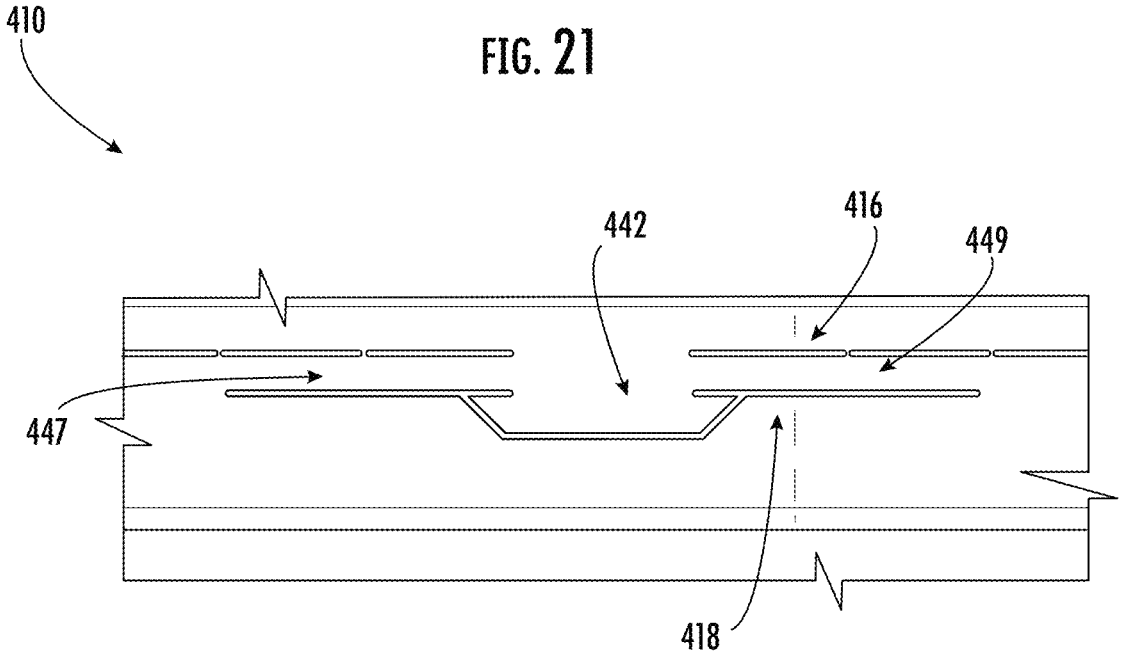
FIG. 22 is a detailed back view of the closure of FIG. 21, according to an exemplary embodiment.

Turning to FIGS. 21-22, various aspects of closure 410 are shown. Closure 410 is similar to closure 10, closure 210 and the other closures except as described herein. Body 412 of closure 410 is separated from retaining band 414 by upper slit 416 and lower slit 418. Body 412 is pivotally coupled to retaining band 414 via left and right tethers 447, 449. Tab 442 extends from body 412 away from top panel of closure 410. The ends of upper slit 416 of closure 410 are circumferentially separated by a width approximately equal to a width of tab 442. Similarly, the upper portion of lower slit 418 extends towards each other into tab 442. As a result, left and right tethers 447, 449 form a more unified connection to body 412 and the end of tab 442 operates more independently of left and right tethers, 447, 449, compared to, for example, closure 310 in which left and right tethers 347, 349 are more separated (best shown FIGS. 17-18).

Figure 23:
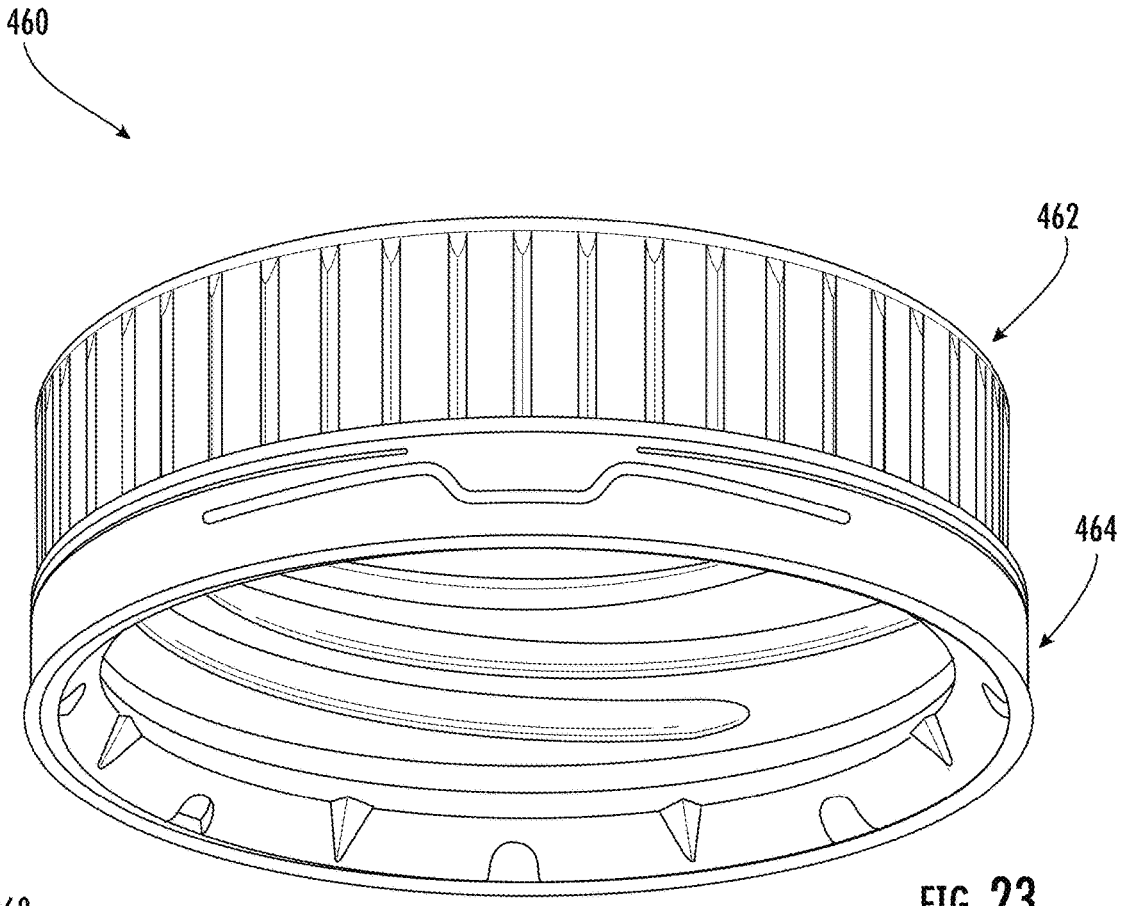
FIG. 23 is a perspective view of a closure, according to an exemplary embodiment.
Figure 24:
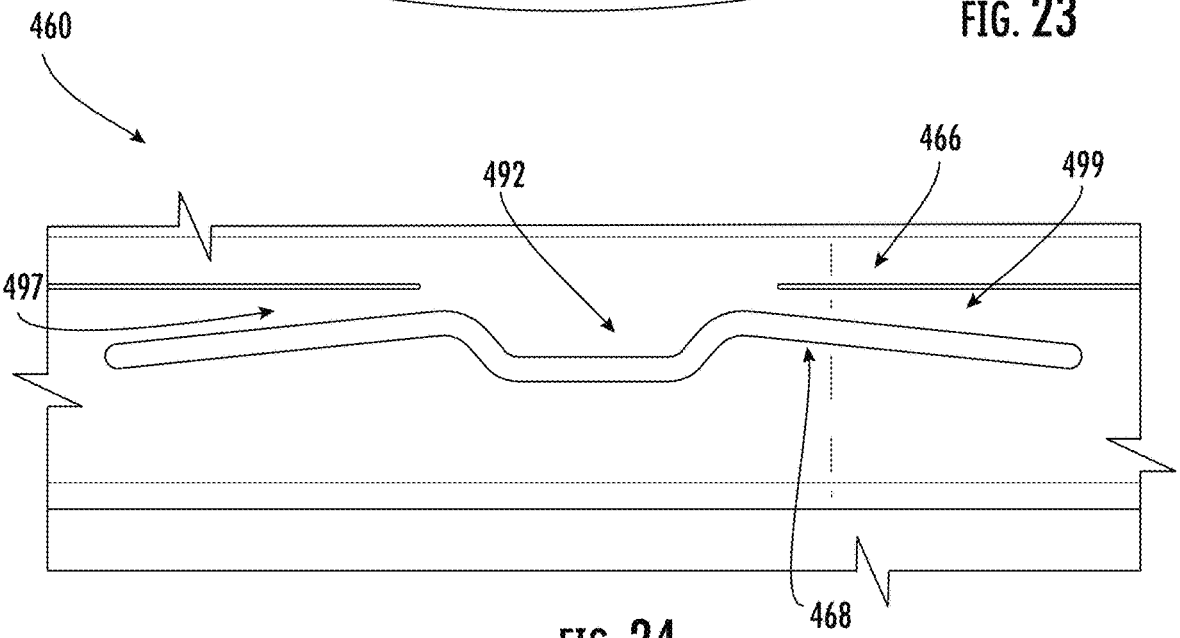
FIG. 24 is a detailed back view of the closure of FIG. 23, according to an exemplary embodiment.

Turning to FIGS. 23-24, various aspects of closure 460 are shown. Closure 460 is similar to closure 10, closure 210 and the other closures except as described herein. Body 462 of closure 460 is separated from retaining band 464 by upper band of weakness 466 and lower band of weakness 468. In a specific embodiment, closure 460 is formed via injection molding. Lower band of weakness 468 extends diagonally away from tab via extending circumferentially away from tab 492 and vertically away from the top panel. Left and right tethers 497, 499 are defined between upper band of weakness 466 and lower band of weakness 468. Tab 492 extends from the hinge in a direction away from body 462. The body 462 pivots with respect to retaining band 464 around the hinge, which is between ends of the upper band of weakness 466.

In various embodiments, one or more of the closures described herein, such as closure 460, are formed by injection molding, compression molding, cutting slits, and/or combinations thereof.

In a specific embodiment, lower band of weakness 468 does not include frangible connections. In an alternate embodiment, lower band of weakness 468 includes one or more frangible connections.

In various embodiments upper band of weakness 466 includes one or more frangible connections, which break upon closure 460 being removed from a container neck. After frangible connections break, body 462 pivots away from retaining band 464, wherein body 462 generally pivots about the hinge with respect to the container neck and retaining band 464. When pivoted open, the tab 492 extends towards a center of container neck and optionally interfaces against a structure on container neck (e.g., a flange) to bias body 462 in an open configuration.

Figure 25:
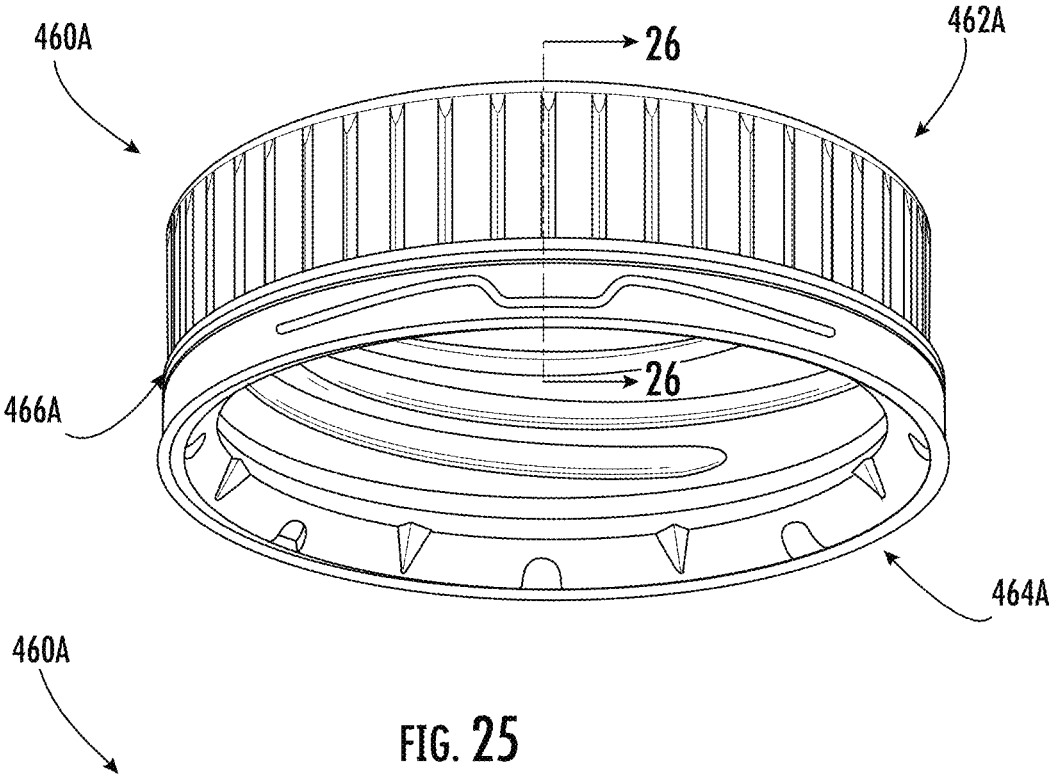
FIG. 25 is a perspective view of a closure, according to an exemplary embodiment.
Figure 26:
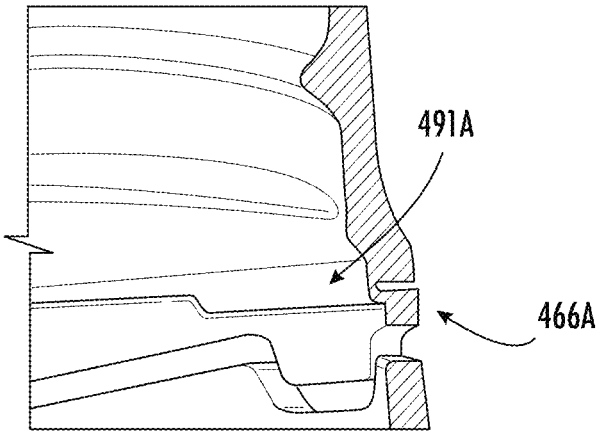
FIG. 26 is a cross-section perspective view of the closure of FIG. 25 taken along line 25-25, according to an exemplary embodiment.
Figure 27:
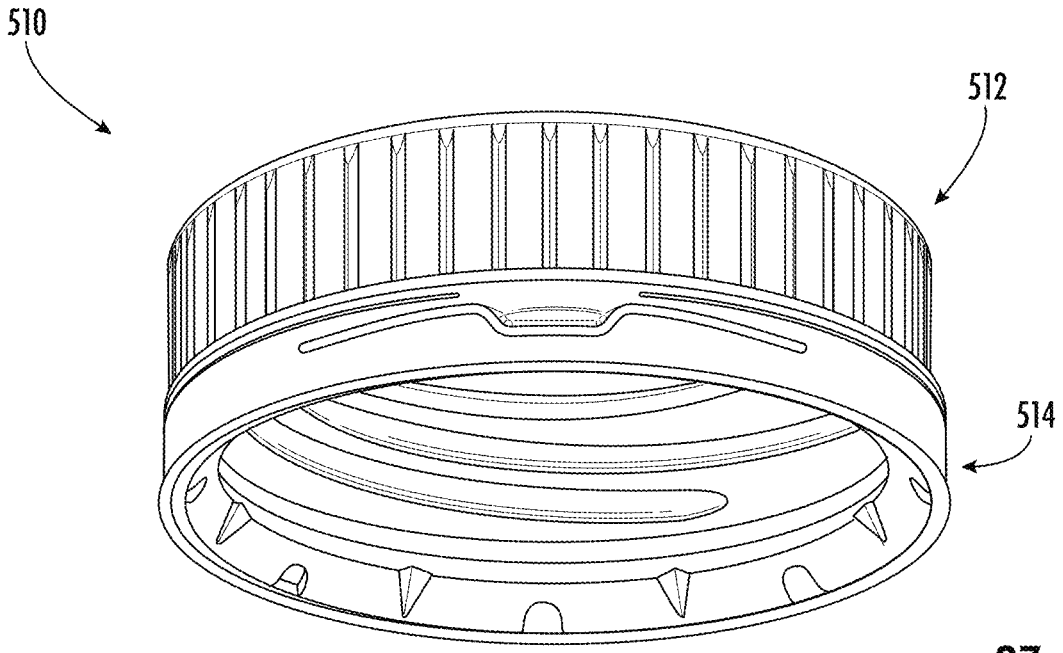
FIG. 27 is a perspective view of a closure, according to an exemplary embodiment.
Figure 28:
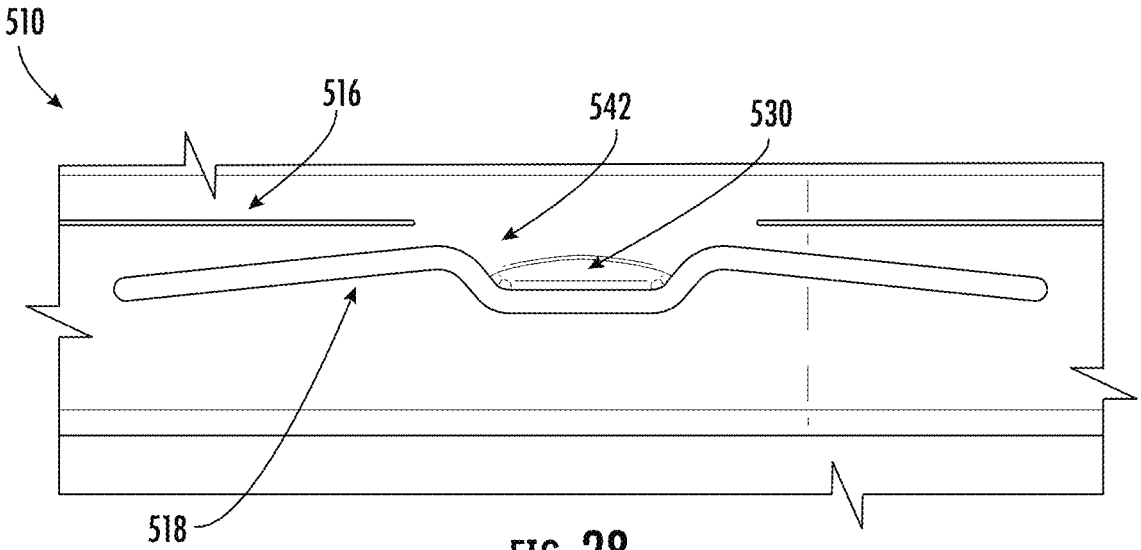
FIG. 28 is a detailed back view of the closure of FIG. 27, according to an exemplary embodiment.
Figure 29:
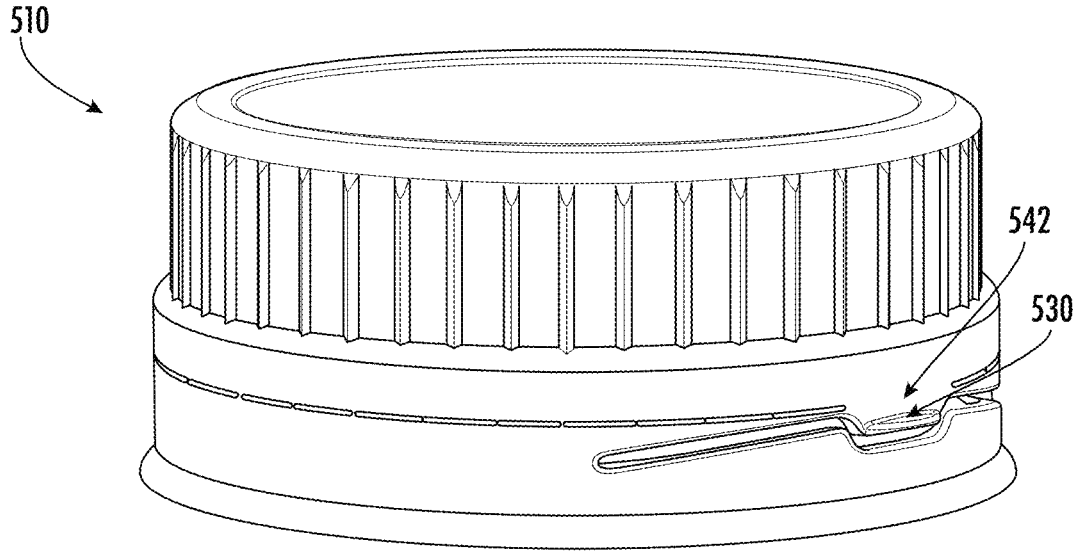
FIG. 29 is a perspective view of the closure of FIG. 27, according to an exemplary embodiment.
Figure 30:
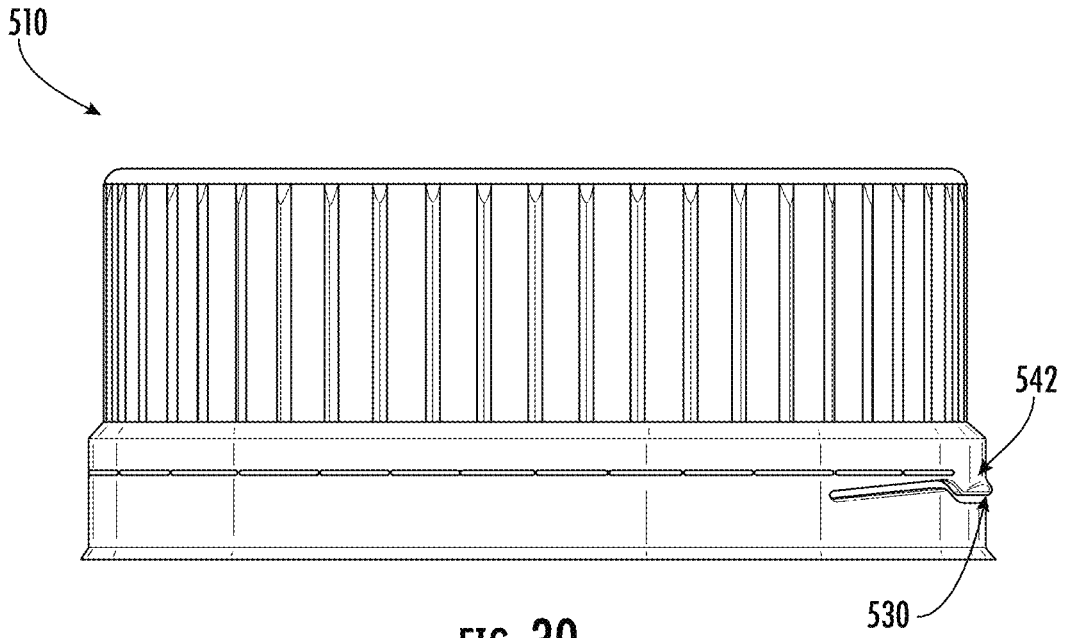
FIG. 30 is a side view of the closure of FIG. 27, according to an exemplary embodiment.

Turning to FIGS. 25-26, various aspects of closure 460A are shown. Closure 460A is similar to closure 10 and particularly closure 460 except as described herein. Upper slit 466A separates body 462A from retainer band 464A. Before closure 460A is opened, a plurality of frangible connections extend across upper slit 466A. Hinge 491A is recessed behind outer surface of closure 460A so that when upper slit 466A is cut, such as via a blade, hinge 491A maintains a connection between body 462A and retainer band 464A.

Turning to FIGS. 27-30, various aspects of closure 510 are shown. Closure 510 is similar to closure 10, closure 210 and the other closures except as described herein. Body 512 of closure 510 is separated from retaining band 514 by upper line of weakness 516 and lower line of weakness 518. When closure 510 is in the opened position and tab 542 is above the annular projection of the container neck (e.g., annular projection 188 in FIG. 6), tab 542 biases body 512 from the container neck. Protrusion 530 extends from tab 542, such as protrusion 530 extending from tab 542 radially away from a central axis of closure 510 (shown in FIGS. 29 and 30). Protrusion 530 interfaces against the container neck to bias the body 512 even further from the container neck compared to if tab 542 did not include protrusion 530.

Figure 31:
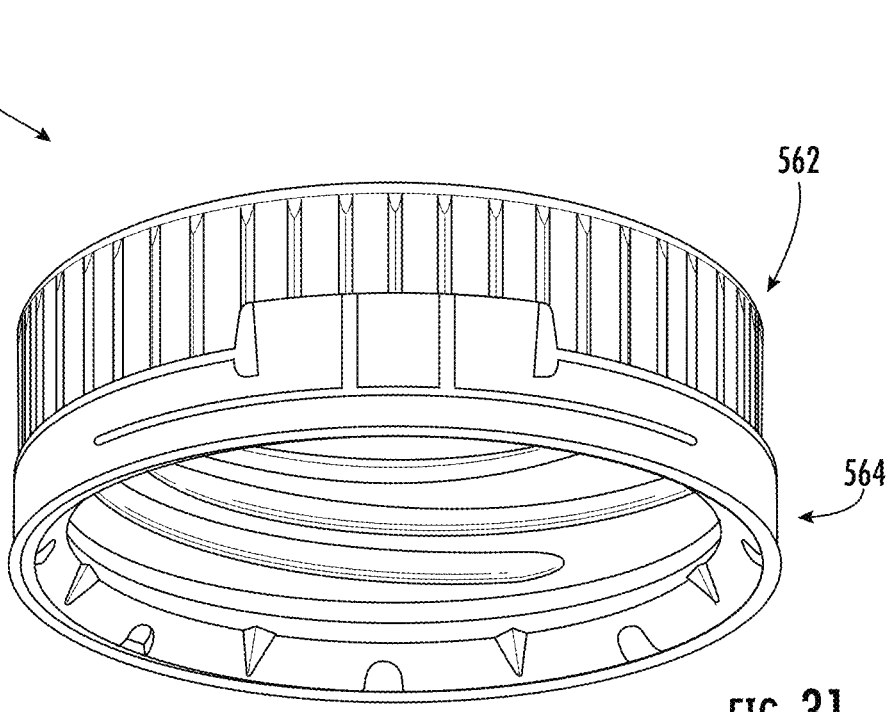
FIG. 31 is a perspective view of a closure, according to an exemplary embodiment.
Figure 32:
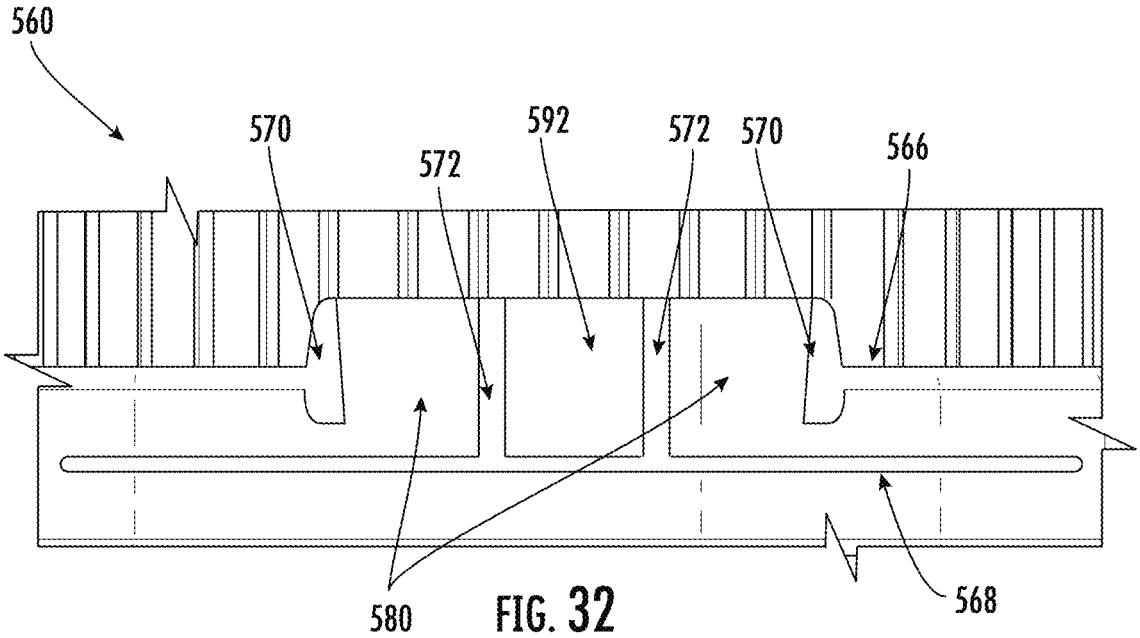
FIG. 32 is a detailed back view of the closure of FIG. 31, according to an exemplary embodiment.

Turning to FIGS. 31-32, various aspects of closure 560 are shown. Closure 560 is similar to closure 10, closure 210 and the other closures except as described herein. Body 562 of closure 560 is separated from retaining band 564 by upper band of weakness 566 and lower band of weakness 568. Lateral apertures 570 are formed at either end of upper band of weakness 566, and tab 592 is partially defined by vertical apertures 572 that extend upwardly from lower band of weakness 568 on either side of tab 592. Hinges 580 are formed between lateral apertures 570 and vertical apertures 572. When closure 560 is rotated open, hinges bias the closure back to the closed position until tab 592 interfaces with container neck to bias the closure body 562 away from the container neck.

In a specific embodiment, upper band of weakness 566 intersects with the lateral apertures 570 at a position between 10% and 60% from the bottom of the lateral apertures 570 to the top of the lateral aperture 570, and more specifically between 20% and 50%, and more specifically between 25% and 40%, and even more specifically 30% and 35%, and even more specifically is 33% from the bottom of the lateral apertures 570. Applicant has observed that this positioning of the upper band of weakness 566 with respect to lateral apertures 570 facilities the closure 560 being pivoted away from and towards the top of the container neck (e.g., being re-coupled to the container neck).

Figure 33:
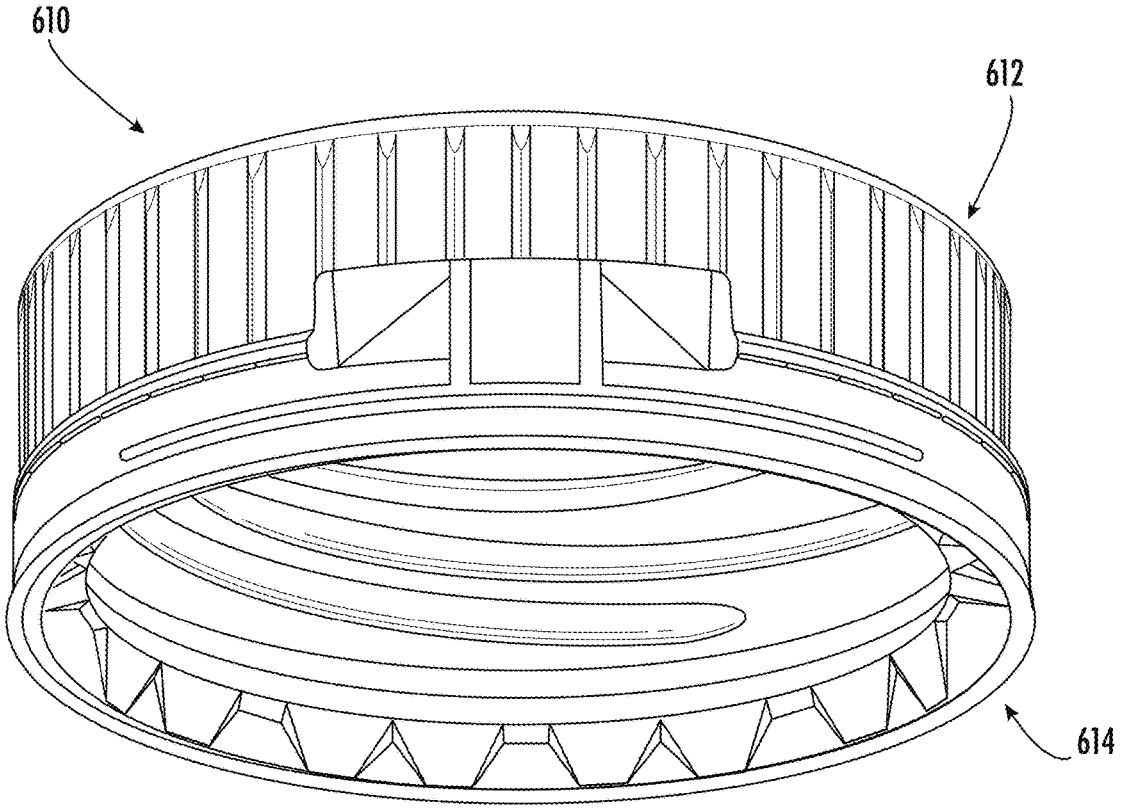
FIG. 33 is a perspective view of a closure, according to an exemplary embodiment.
Figure 34:
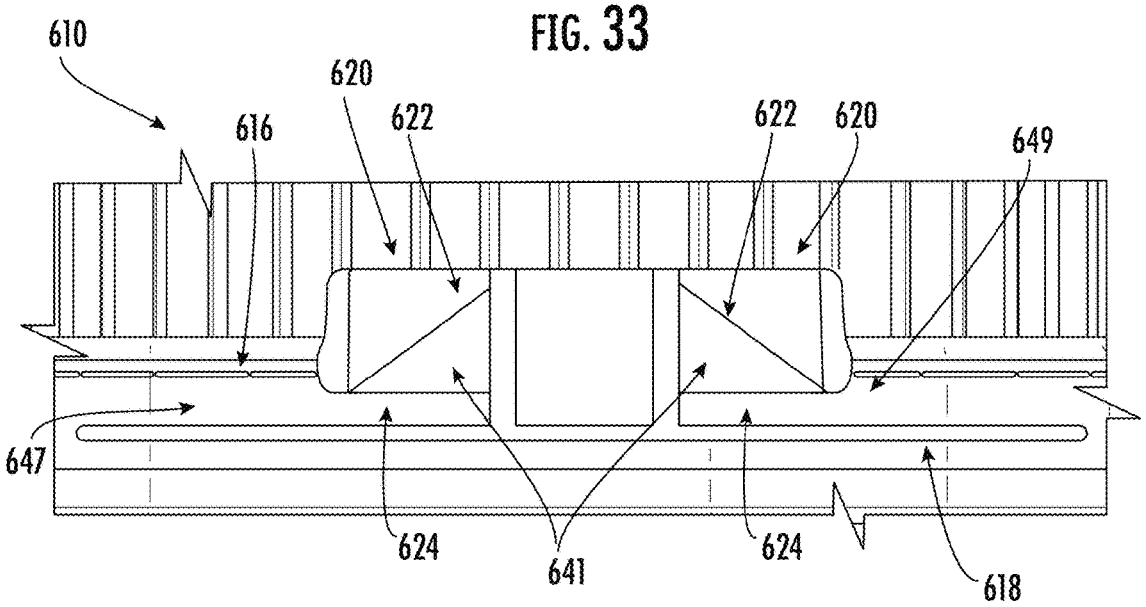
FIG. 34 is a detailed back view of the closure of FIG. 33, according to an exemplary embodiment.

Turning to FIGS. 33-34, various aspects of closure 610 are shown. Closure 610 is similar to closure 10, closure 210, closure 560 and the other closures except as described herein. Body 612 of closure 610 is separated from retaining band 614 by upper line of weakness 616 and lower line of weakness 618. As will be observed, vertical portions of left and right tethers 647 and 649 include diagonal lines of weaknesses 620. Applicant has observed that this positioning of lines of weakness 620 facilities the closure 610 being pivoted away from and towards the top of the container neck (e.g., being re-coupled to the container neck). Left and right tethers 647 and 649 extend between retaining band 614 and hinges 641. In various embodiments, when closure 610 is opened the hinges 641 are predisposed to bend along lines of weakness 620 because the thickness of left and right tethers 647 and 649 is thinner above lines of weakness 620 than below lines of weakness 620.

Similarly, in various embodiments when closure 610 is opened then closure 610 is predisposed to bend along upper edge 622 because the annular wall is thicker above upper edge 622 than the thickness of hinges 641 below upper edge 622. Similarly, in various embodiments when closure 610 is opened then closure 610 is predisposed to bend along lower edge 624 because retaining band 614 below lower edge 624 has a different thickness than hinges 641. Applicant has observed that these various configurations of lines of weakness in the interactions between the hinge and the rest of the closure facilitates the closure 610 being pivoted away from and towards the top of the container neck (e.g., being re-coupled to the container neck).

In various embodiments of closures 610 and one or more other embodiments generally, the hinges/tethers and posts are recessed within the closure body so that a blade cutting one or more lines of weakness in the closure does not fully cut through the hinges/tethers and/or the posts.

Figure 35:
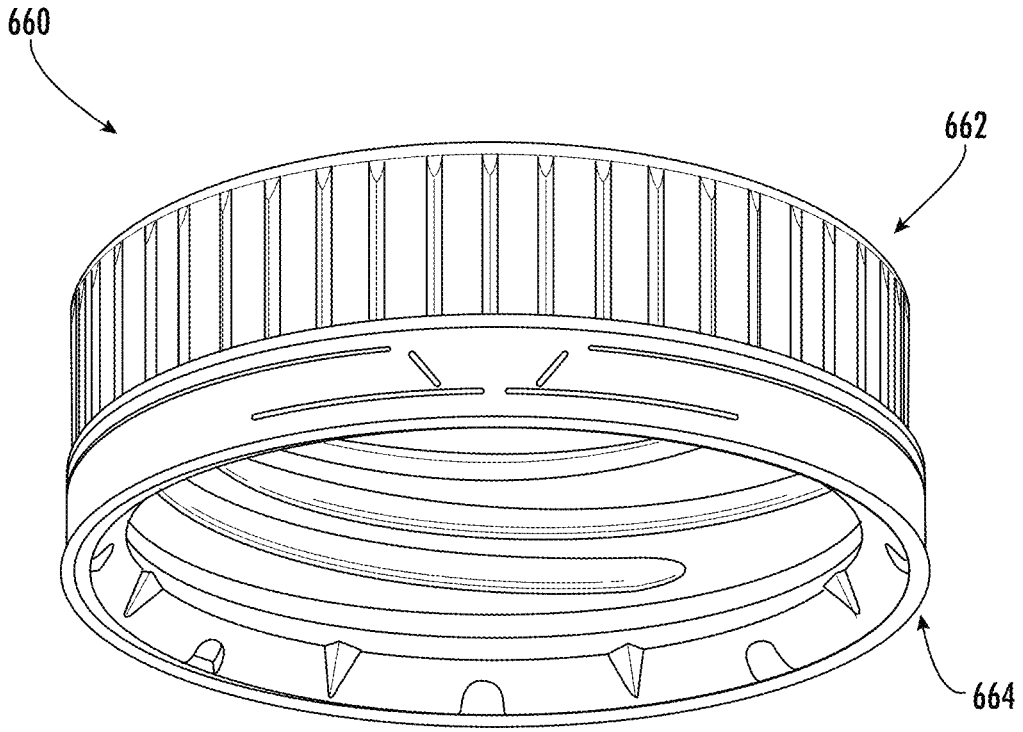
FIG. 35 is a perspective view of a closure, according to an exemplary embodiment.
Figure 36:
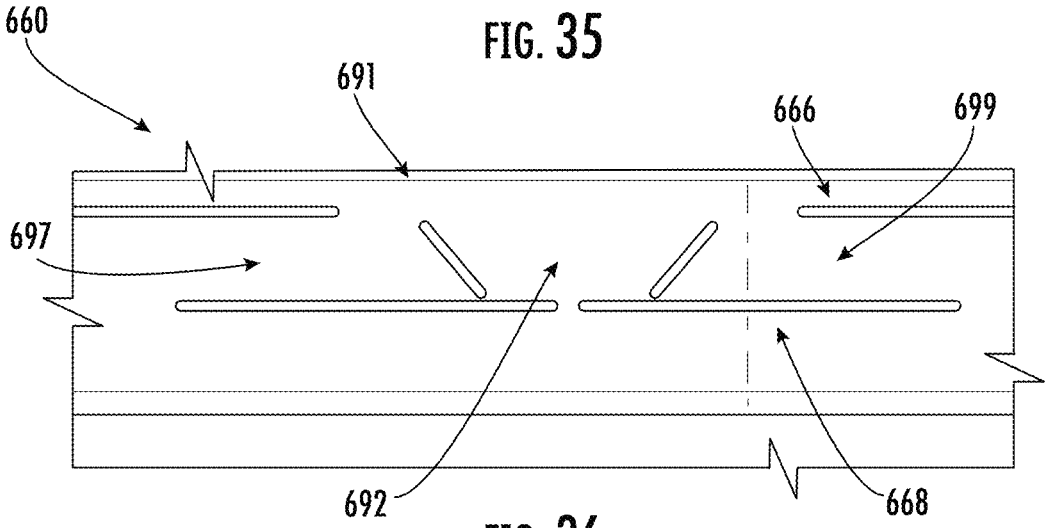
FIG. 36 is a detailed back view of the closure of FIG. 35, according to an exemplary embodiment.

Turning to FIGS. 35-36, various aspects of closure 660 are shown. Closure 660 is similar to closure 10, closure 210 and the other closures except as described herein. Body 662 of closure 660 is separated from retaining band 664 by upper slit 666 and lower slit 668. Left and rights tethers 697 and 699 extend between retaining band 664 and hinge 691. A tab 692 is formed at a hinge location 691 from the retaining band 664 and extends from the lower edge of the body 662. The tab 692 is bounded by a pair of diagonal slits extending from lower slit 668.

In a specific embodiment, each of the diagonal slits extends from the circumferential portion of the lower slit 668 at an angle from 40° to 50° relative to the horizontal axis, and more specifically 45°. As shown in FIGS. 35-36, tab 692 has a shape of a trapezoid.

In a various embodiments, the closures described herein are injection molded or compression molded from materials such as polypropylene, high density polypropylene, high density polyethylene, or low density polyethylene. In a specific embodiment, the closures are injection molded as one entire piece. The material of the closures is such that allows for varying degrees of freedom of movement of the tab and hinge portions.

In a specific embodiment, the circumferential arc length of the upper slit 666 is 300 degrees, leaving a 60 degree window, and the circumferential arc length of the lower slit 668 is 34-35 degrees, and the angle between of diagonal slits extending from the lower portion of lower band of slits 668 is 50 degrees.

Figure 37:
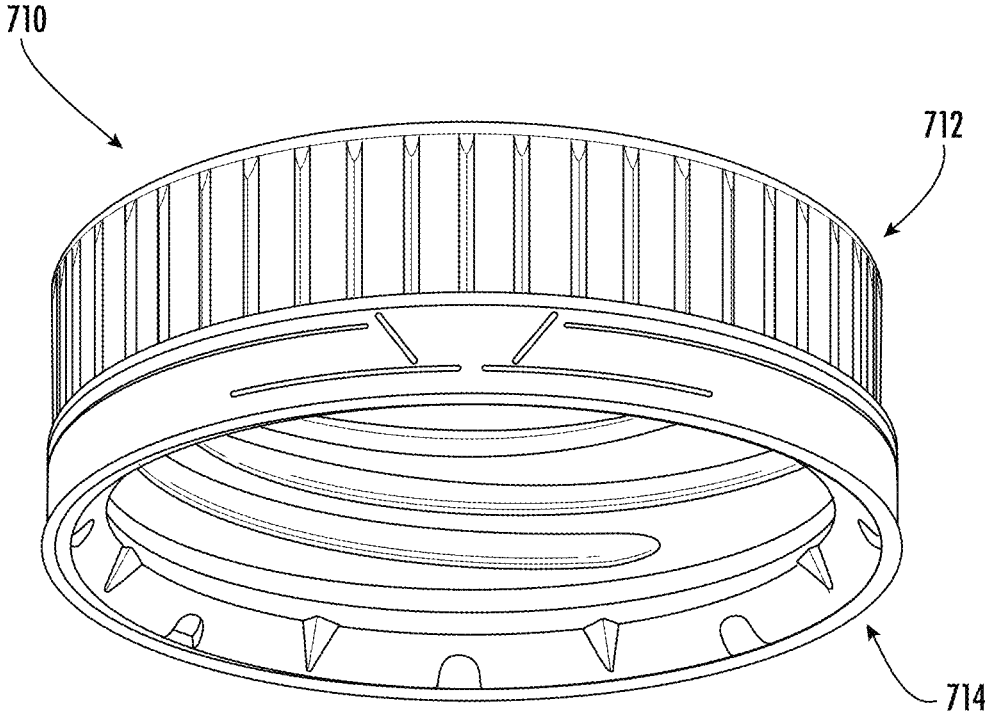
FIG. 37 is a perspective view of a closure, according to an exemplary embodiment.
Figure 38:
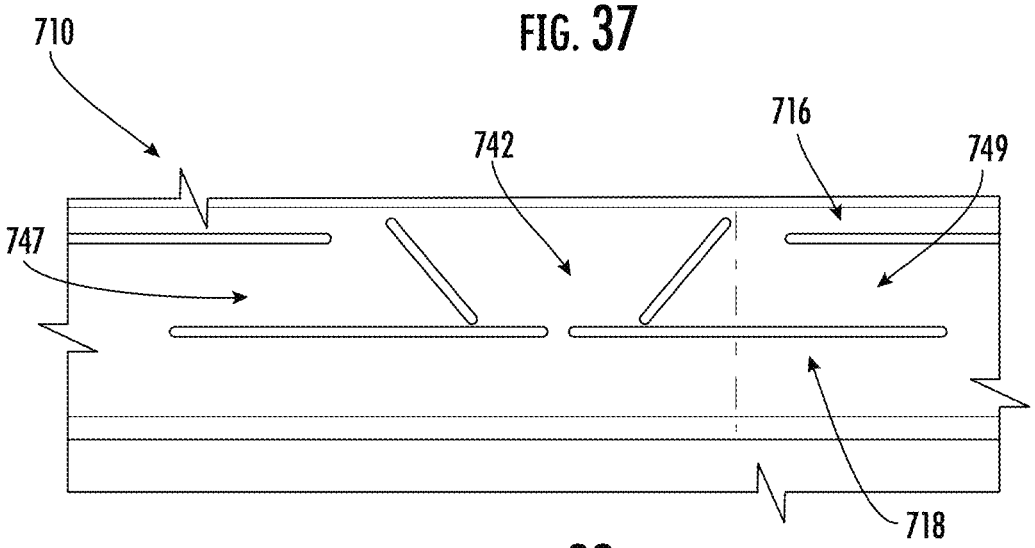
FIG. 38 is a detailed back view of the closure of FIG. 37, according to an exemplary embodiment.

Turning to FIGS. 37-38, various aspects of closure 710 are shown. Closure 710 is similar to closure 10, closure 210 and the other closures except as described herein. Body 712 of closure 710 is separated from retaining band 714 by upper slit 716 and lower slit 718. Closure 710 is similar to closure 660 with the exception that diagonal slits extend from lower slit 718 further from lower slit 718 above upper slit 716. Left and right tethers 747 and 749 extend between retaining band 714 and body 712. Tab 742 extends from body 712, and pivots towards the container neck when the body 712 is pivoted away from the container neck and retaining band 714.

Figure 39:
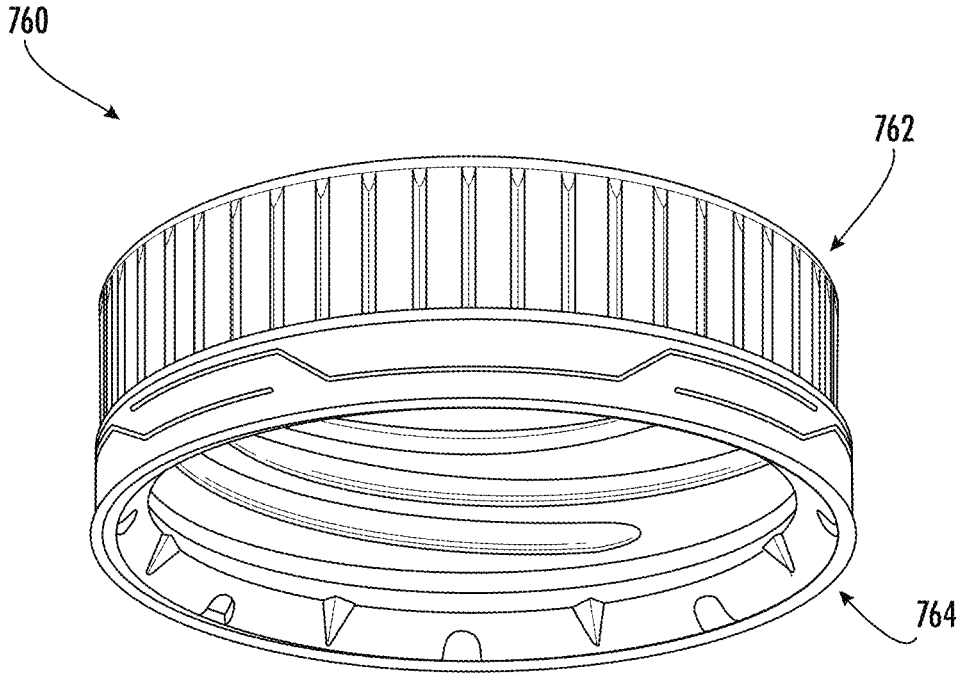
FIG. 39 is a perspective view of a closure, according to an exemplary embodiment.
Figure 40:
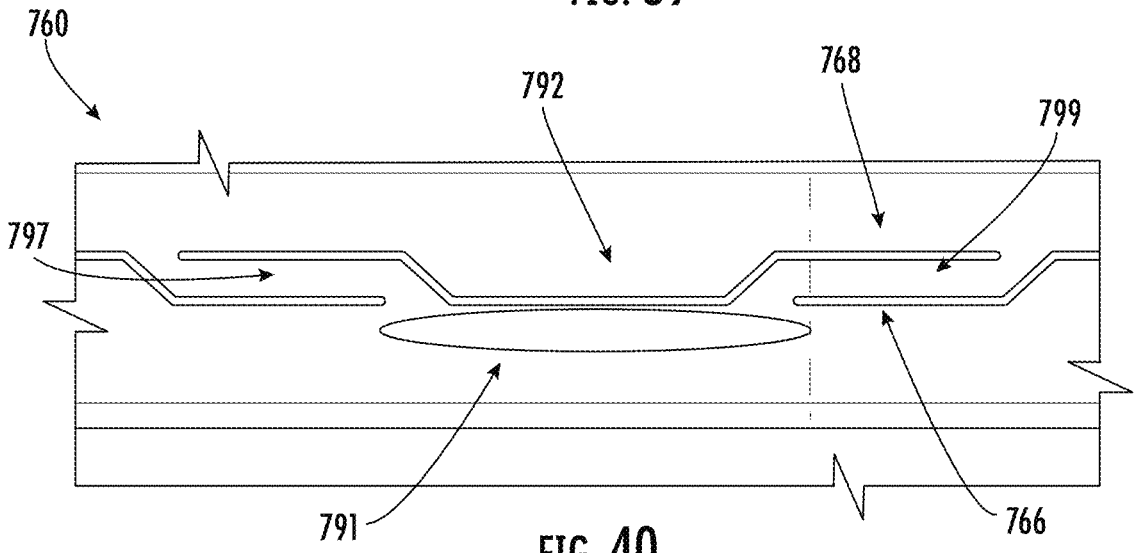
FIG. 40 is a detailed back view of the closure of FIG. 39, according to an exemplary embodiment.

Turning to FIGS. 39-40, various aspects of closure 760 are shown. Closure 760 is similar to closure 10, closure 210 and the other closures except as described herein. Body 762 of closure 760 is separated from retaining band 764 by first slit 766 and second slit 768. As will be observed, left and right tethers 797 and 799 extend from body 762 to a central hinge 791, which for this closure extends from retaining band 764. Tab 792 is defined by second slit 768 and extends from body 762.

Figure 41:
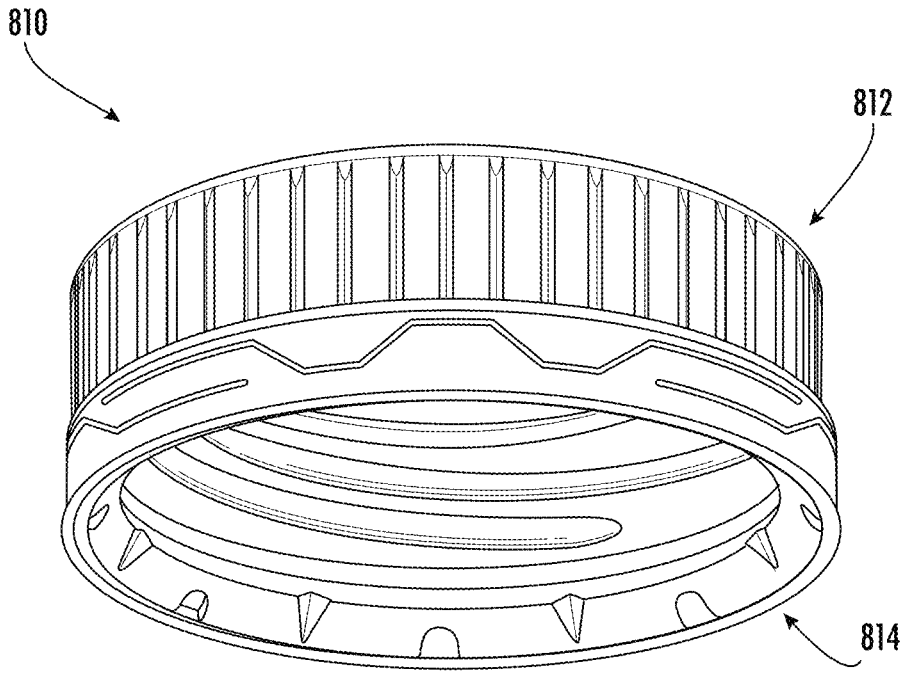
FIG. 41 is a perspective view of a closure, according to an exemplary embodiment.
Figure 42:
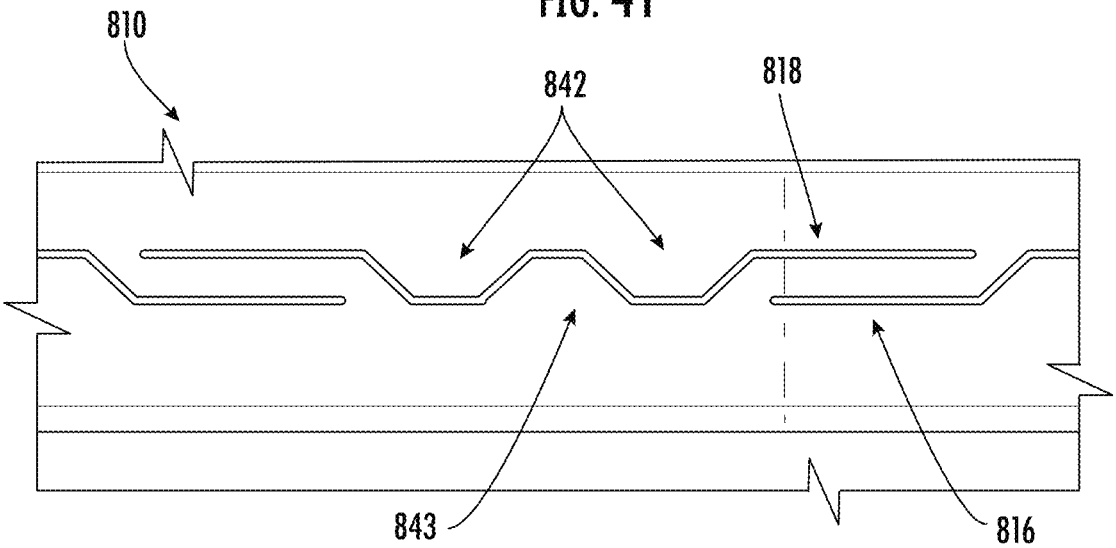
FIG. 42 is a detailed back view of the closure of FIG. 41, according to an exemplary embodiment.
Figure 43:
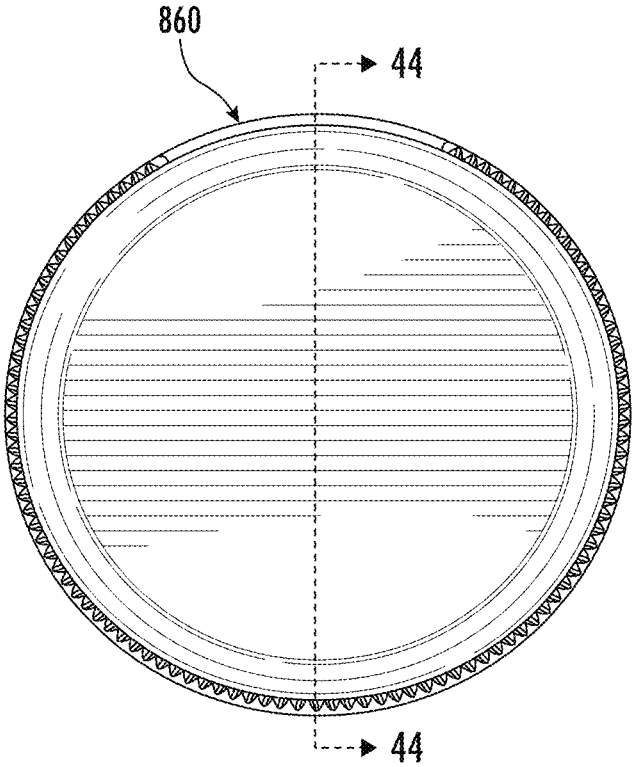
FIG. 43 is a top view of a closure, according to an exemplary embodiment.
Figure 44:
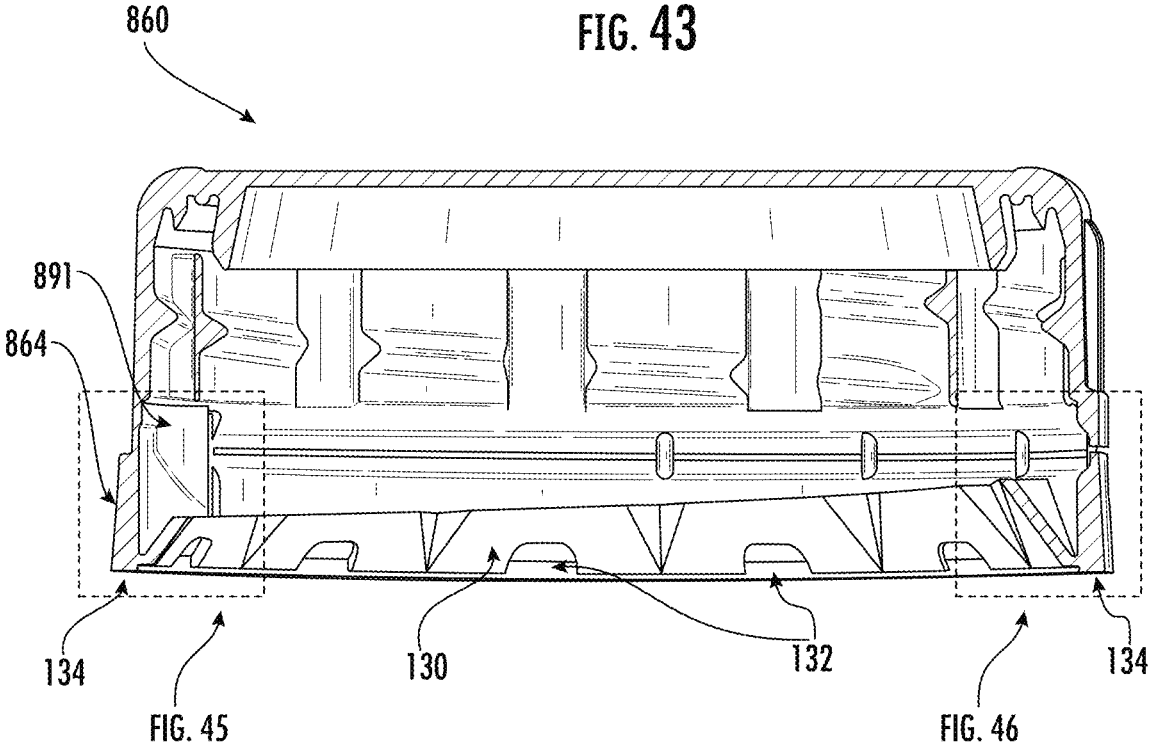
FIG. 44 is a cross-section view of the closure of FIG. 43 taken along line 44-44.
Figure 45:
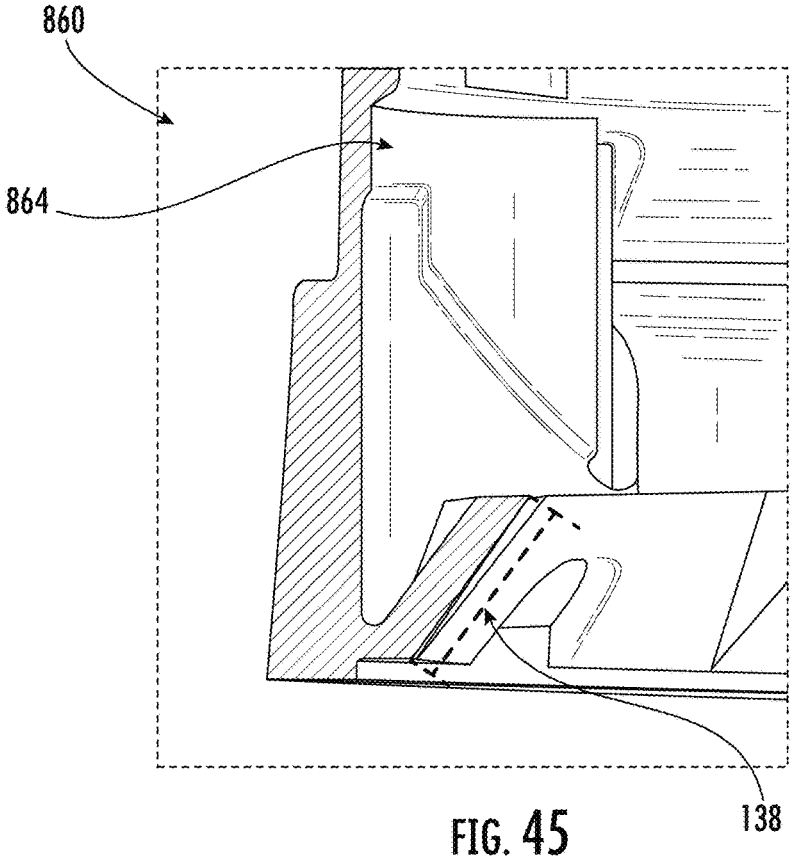
FIG. 45 is a detailed cross-section view of the closure of FIG. 43 taken along line 44-44.
Figure 46:
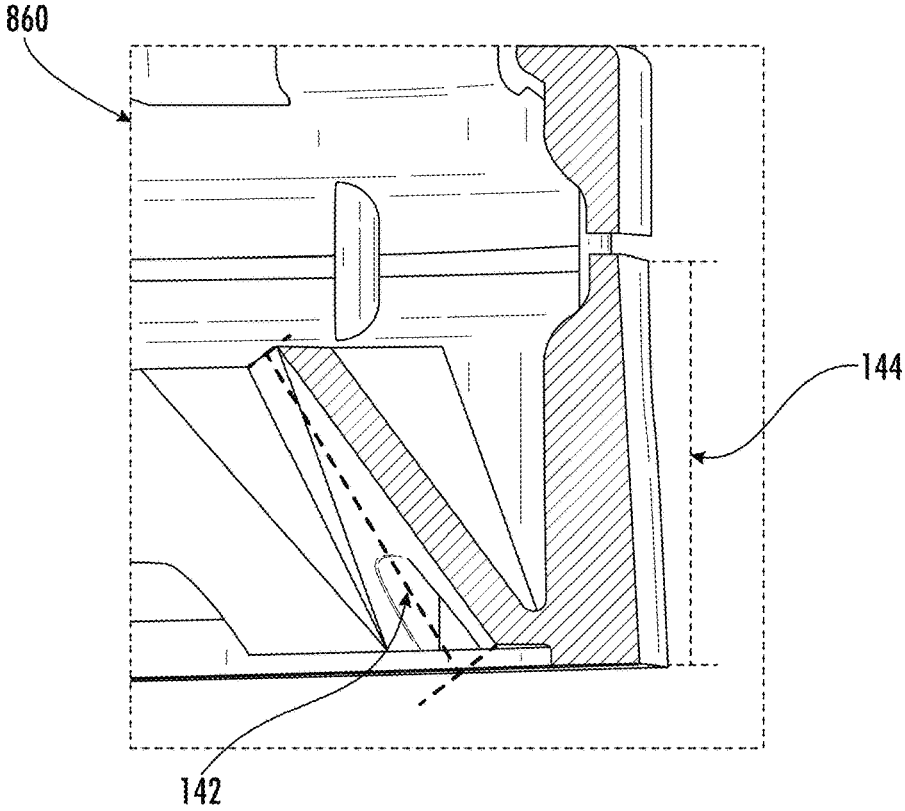
FIG. 46 is a detailed cross-section view of the closure of FIG. 43 taken along line 44-44.

Turning to FIGS. 41-42, various aspects of closure 810 are shown. Closure 810 is similar to closure 10, closure 210, and especially closure 760, and the other closures except as described herein. Body 812 of closure 810 is separated from retaining band 814 by first slit 816 and second slit 818. Partition 843 separates tabs 842, which extend from body 812.

Turning to FIGS. 43-46, various aspects of closure 860 and retaining band 864 are shown. Closure 760 is similar to closure 10, closure 210 and the other closures except as described herein. Similarly, retaining band 864 is similar to retaining band 100 except as described herein. It is contemplated herein that retaining band 864 may be incorporated with any of the closures described herein.

Interference band 130 extends from retaining band 864 and includes a tapered formation that facilitates the body of the closure pivoting away from interference band 130, particularly when the closure includes a hinged, tethered formation that couples the body of the closure to the retaining band. Interference band 130 extends inwards from base 134 of retention band 864. Interference band 130 defines one or more apertures 132.

Interference band 130 extends a varying distance from base 134 at different circumferential positions with respect to axis 8. At the one or more locations below hinge 891 and/or the tab (see FIG. 45), interference band 130 has length 138. At the one or more locations opposite hinge 891 with respect to rotational axis 8 (see FIG. 46), interference band 130 has length 142, which is longer than length 138. In a specific embodiment, base 134 defines distance 144 between top of retention band 864 and base 134 of retention band 864, when closure 860 is in the closed arrangement.

In a specific embodiment, length 138 is less than 60% of length 142. In a specific embodiment, length 138 is less than 50% of distance 144.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a first tether that extends from the cylindrical wall;

a second tether that extends from the cylindrical wall;

a retention band pivotally coupled to the cylindrical wall by the first tether and the second tether, the retention band attached to the bottom edge by a plurality of frangible members, the frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially around the closure from a first end to a second end; and a second line of weakness at least a portion of which is below the first line of weakness, the second line of weakness including a tab portion and first lateral sections that extend circumferentially away from the tab portion, wherein the tab portion define a first height from the top panel and the first lateral sections define a second height from the top panel that is less than the first height, and wherein the tab portion includes second lateral sections that extend circumferentially away from the first lateral sections and that define a third height from the top panel greater than the second height, and wherein the third height is equal to the first height, and wherein the first lateral sections are between the first end and the second end of the first line of weakness, wherein the tab portion defines an angle between 110 degrees and 160 degrees with respect to a connecting portion of the second line of weakness that extends from the tab portion, and wherein no portion of the first line of weakness is further from the top panel than the second line of weakness;

wherein the first tether is defined between the second line of weakness and the first end of the first line of weakness, and the second tether is defined between the second line of weakness and the second end of the first line of weakness.

2. The closure of claim 1, wherein the closure is formed via injection molding.

3. The closure of claim 2, wherein the second line of weakness extends circumferentially away from the tab and vertically away from the top panel.

4. The closure of claim 1, wherein the first line of weakness defines a fourth height from the top panel that is no shorter than the first height.

5. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

two tethers that extend from the cylindrical wall;

a retention band pivotally coupled to the cylindrical wall by the two tethers, the retention band attached to the bottom edge by a plurality of frangible members, the frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially around the closure from a first end to a second end; and a second line of weakness, the second line of weakness including a tab portion that defines a first height from the top panel, first lateral sections that extend circumferentially away from the tab portion and that define a second height from the top panel less than the first height, and second lateral sections that extend circumferentially away from the first lateral sections and that define a third height from the top panel greater than the second height, wherein the third height is equal to the first height, and wherein no portion of the first line of weakness is further from the top panel than the second line of weakness;

wherein a first tether of the two tethers is defined between the second line of weakness and the first end of the first line of weakness, and a second tether of the two tethers is defined between the second line of weakness and the second end of the first line of weakness.

6. The closure of claim 5, wherein the first line of weakness defines a height from the top panel that is no shorter than the second height.

7. The closure of claim 5, wherein the first line of weakness defines a height from the top panel that is equal to the second height.

8. The closure of claim 5, wherein the tab portion defines an angle between 110 degrees and 160 degrees with respect to a connecting portion of the second line of weakness that extends from the tab portion.

9. The closure of claim 5, wherein the second line of weakness defines a first partition and a second partition, each of which extending towards the top panel, wherein the first partition is located between the tab portion and the first tether, and the second partition is located between the tab portion and the second tether.

10. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

two tethers that extend from the cylindrical wall;

a retention band pivotally coupled to the cylindrical wall by the two tethers, the retention band attached to the bottom edge by a plurality of frangible members, the frangible members providing a visual indication, when broken, that the closure has been opened;

a first line of weakness that separates the cylindrical wall and the retention band a first height from the top panel, wherein the plurality of frangible members extend across the first line of weakness and connect the cylindrical wall and the retention band, the first line of weakness extending circumferentially around the closure from a first end to a second end; and a second line of weakness, the second line of weakness including a tab portion that defines a second height from the top panel, and first lateral sections that extend circumferentially away from the tab portion and that define a third height from the top panel that is less than the second height, wherein the tab portion defines an angle between 120 degrees and 150 degrees with respect to a connecting portion of the second line of weakness that extends from the tab portion, and wherein the tab portion includes second lateral sections that extend circumferentially away from the first lateral sections and that define a fourth height from the top panel greater than the third height, and wherein the fourth height is equal to the second height, and wherein no portion of the first line of weakness is further from the top panel than the second line of weakness;

wherein a first tether of the two tethers is defined between the second line of weakness and the first end of the first line of weakness, and a second tether of the two tethers is defined between the second line of weakness and the second end of the first line of weakness.

11. The closure of claim 10, wherein the first height is no shorter than the third height.

12. The closure of claim 10, wherein the second line of weakness defines a first partition and a second partition, each of which extending towards the top panel, wherein the first partition is located between the tab portion and the first tether, and the second partition is located between the tab portion and the second tether.

13. The closure of claim 10, wherein the closure is formed via injection molding.

* * * * *